US006390198B2

(12) United States Patent
Brooks et al.

(10) Patent No.: US 6,390,198 B2
(45) Date of Patent: May 21, 2002

(54) METHOD FOR RUNNING TWO TUBING STRINGS INTO A WELL

(75) Inventors: Robert T. Brooks, Houston; David J. Steele, Irving; Dan P. Saurer, Richardson; Larry R. Valentine, Desoto; Jody R. McGlothen, Waxahachie, all of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/765,938

(22) Filed: Jan. 19, 2001

Related U.S. Application Data

(63) Continuation of application No. 09/240,370, filed on Jan. 29, 1999, now abandoned.
(60) Provisional application No. 60/073,083, filed on Jan. 30, 1998.

(51) Int. Cl.[7] ..... E21B 43/00
(52) U.S. Cl. ..... 166/313; 166/117.5
(58) Field of Search ..... 166/50, 117.5, 166/117.6, 242.3, 381, 313

(56) References Cited

U.S. PATENT DOCUMENTS

| | | | | |
|---|---|---|---|---|
| 2,397,070 A | | 3/1946 | Zublin | |
| 2,797,893 A | | 7/1957 | McCune et al. | |
| 2,804,926 A | | 9/1957 | Zublin | |
| 2,858,107 A | | 10/1958 | Colmerauer | |
| 3,842,912 A | | 10/1974 | Lindsey, Jr. | |
| 4,003,434 A | | 1/1977 | Garrett et al. | |
| 4,374,543 A | | 2/1983 | Richardson | |
| 4,420,049 A | | 12/1983 | Holbert | |
| 4,440,222 A | * | 4/1984 | Pullin | 166/117.5 |

(List continued on next page.)

FOREIGN PATENT DOCUMENTS

| | | |
|---|---|---|
| EP | 0701040 A3 | 3/1996 |
| GB | 2195731 A | 4/1988 |
| GB | 2297988 A | 8/1996 |
| WO | WO97/07318 | 2/1997 |

OTHER PUBLICATIONS

International Search Report Application No.: PCT/US99/02117.

U.S. application No. 09/159,530, filed Sep. 23, 1998, "Self–Locating Reentry System for Downhole Well Completions." (Jan. 15, 1997).

(List continued on next page.)

*Primary Examiner*—David Bagnell
*Assistant Examiner*—Nathan Mammen
(74) *Attorney, Agent, or Firm*—William M. Imwalle; Marlin R. Smith

(57) ABSTRACT

A well has a vertical casing with a window, and a lateral wellbore which communicates with the window, and which may have a casing or liner. A window assembly aligned with the window has respective passageways for first and second tubing strings, and has a concave surface for deflecting the first tubing string out into the lateral wellbore. The passageway for the second tubing string has a portion which is inclined at a very small angle with respect to a vertical centerline of the vertical casing. As the first tubing string is run into the vertical casing, a rotational locator is releasably coupled thereto by a soft release coupling mechanism. After the locator effects rotational orientation, the coupling mechanism is released and then permits the first tubing string to move therepast without damage. A seal assembly on the first tubing string is covered by a protective sleeve as it is inserted into the well, and exits the protective sleeve after entering the lateral wellbore.

17 Claims, 19 Drawing Sheets

U.S. PATENT DOCUMENTS

| | | | | |
|---|---|---|---|---|
| 4,510,995 | A | | 4/1985 | Krause, Jr. et al. |
| 4,766,956 | A | | 8/1988 | Smith et al. |
| 4,848,820 | A | | 7/1989 | Morrell |
| 4,928,767 | A | | 5/1990 | Salsnia |
| 5,163,514 | A | | 11/1992 | Jennings |
| 5,222,554 | A | | 6/1993 | Blount et al. |
| 5,311,936 | A | | 5/1994 | McNair et al. |
| 5,318,121 | A | | 6/1994 | Brockman et al. |
| 5,325,924 | A | | 7/1994 | Bangert et al. |
| 5,353,876 | A | * | 10/1994 | Curington et al. ..... 166/313 |
| 5,388,648 | A | | 2/1995 | Jordan, Jr. |
| 5,425,419 | A | | 6/1995 | Sieber |
| 5,427,177 | A | | 6/1995 | Jordan, Jr. et al. |
| 5,427,179 | A | | 6/1995 | Bailey et al. |
| 5,431,219 | A | | 7/1995 | Leising et al. |
| 5,458,209 | A | | 10/1995 | Hayes et al. |
| 5,467,819 | A | | 11/1995 | Braddick |
| 5,474,131 | A | | 12/1995 | Jordan, Jr. et al. |
| 5,477,925 | A | | 12/1995 | Trahan et al. |
| 5,484,017 | A | | 1/1996 | Coon |
| 5,518,072 | A | | 5/1996 | McPernaghan |
| 5,520,252 | A | | 5/1996 | McNair |
| 5,533,573 | A | | 7/1996 | Jordan, Jr. et al. |
| 5,535,822 | A | | 7/1996 | Schock et al. |
| 5,564,503 | A | | 10/1996 | Longbottom et al. |
| 5,649,595 | A | | 7/1997 | Davis et al. |
| 5,651,415 | A | | 7/1997 | Scales |
| 5,678,634 | A | | 10/1997 | Rehbock et al. |
| 5,697,445 | A | | 12/1997 | Graham |
| 5,715,891 | A | | 2/1998 | Graham |
| 5,730,224 | A | | 3/1998 | Williamson et al. |
| 5,732,773 | A | * | 3/1998 | Parks et al. ..... 166/117.5 |
| 5,787,987 | A | | 8/1998 | Forsyth et al. |
| 5,806,614 | A | | 9/1998 | Nelson |
| 5,964,287 | A | | 10/1999 | Brooks |
| 5,975,208 | A | | 11/1999 | Brooks |
| 6,019,173 | A | | 2/2000 | Saurer et al. |
| 6,158,513 | A | * | 12/2000 | Nistor et al. ..... 166/313 |
| 6,305,475 | B1 | * | 10/2001 | Carnahan ..... 166/313 |
| 6,311,776 | B1 | * | 11/2001 | Pringle et al. ..... 166/313 |

OTHER PUBLICATIONS

U.S. application No. 60/073,153, filed Jan. 30, 1998, "Method and Apparatus for One–Trip insertion and Retrieval of a Tool and Auxillary Device" (Jan. 16, 1997).

PCE Advertisement Thru Tubing Multi Lateral Re–Entry System (MLR™) one page, dated 1995©.

Great Britain Journal of Patents Nov. 13, 1996, Official Journal (Patents) one page, dated 1996.

Schlumberger Horizontal Well–Complete Analysis. Production Logging, Deft Specifications, Two pages, dated Mar. 10, 1997.

PCT International Search Report (Partial) for Int'l Application PCT/US98/06603 filed Apr. 3, 1998.

PCT International Search Report for Int'l Application PCT/US98/06653 filed Apr. 3, 1998.

PCT International Search Report for Int'l Application PCT/US98/06658 filed Apr. 3, 1998.

Inpadoc/Fam. & Legal Stat. 1998 Report–5 pages.

* cited by examiner

FIG. 13
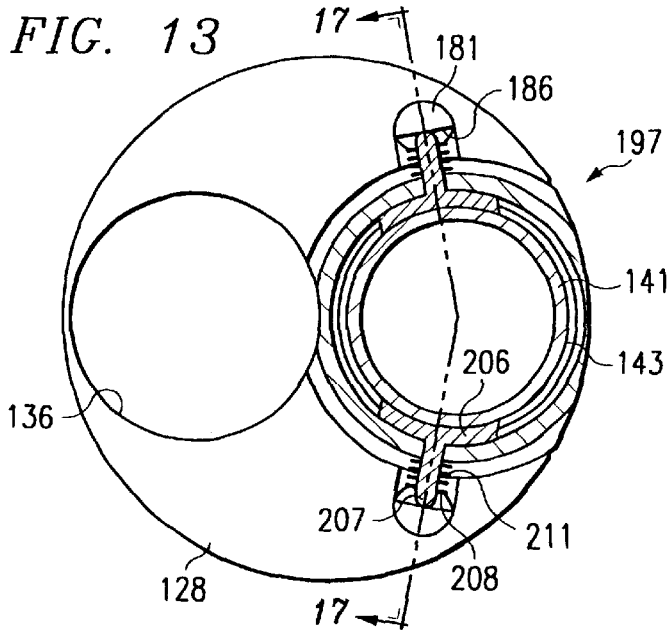
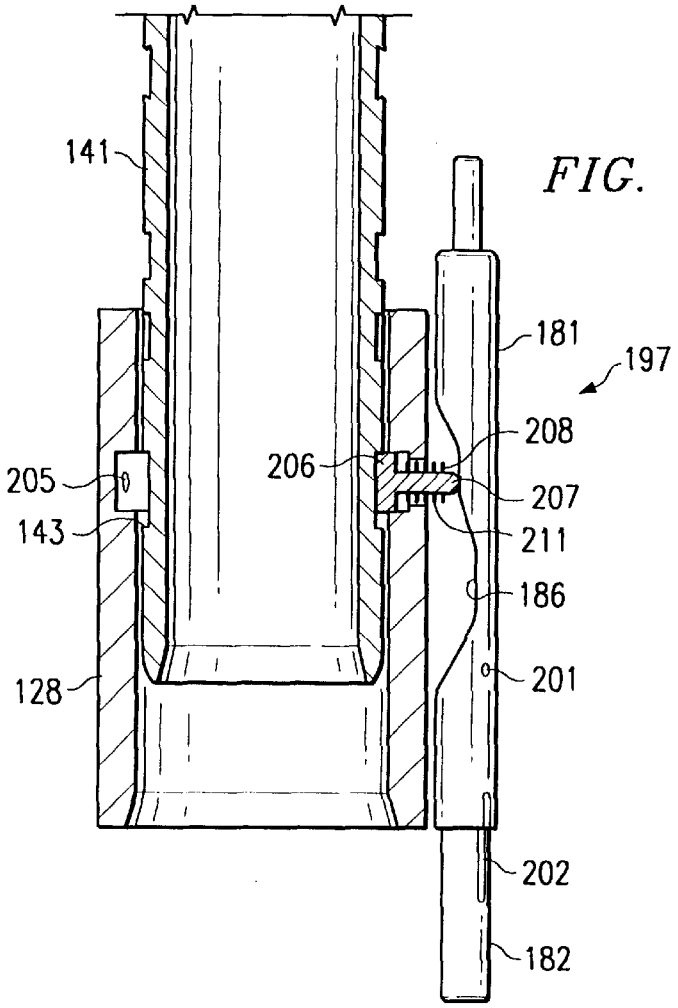
FIG. 17

METHOD FOR RUNNING TWO TUBING STRINGS INTO A WELL

This is a continuation of Application Ser. No. 09/240,370, filed Jan. 29, 1999, abandoned such prior application being incorporated by reference herein in its entirety.

RELATED APPLICATIONS

This application claims the benefit of U.S. Provisional Application Ser. No. 60/073,083, filed Jan. 30, 1998.

This application is related to copending U.S. patent application Ser. No. 09/240,290, filed Jan. 29, 1999, entitled "Method and Apparatus for One-Trip Insertion and Retrieval of a Tool and Auxiliary Device", now U.S. Pat. No. 6,308,782.

TECHNICAL FIELD OF THE INVENTION

This invention relates in general to equipment for use with a well having a vertical bore and at least one lateral bore and, more particularly, to a method and apparatus for running into the well two tubing strings which respectively extend to the vertical bore and the lateral bore.

BACKGROUND OF THE INVENTION

A well for the production of hydrocarbons will have a vertical bore, and often has at least one lateral bore that communicates with the vertical bore through a window. It is possible to simultaneously produce hydrocarbons from both the vertical bore and lateral bore, by running a pair of tubing strings into the well, such that one tubing string is disposed in and effects production from the vertical bore, and the other tubing string is disposed in and effects production from the lateral bore. Although dual tubing string equipment has been developed for this purpose, and has been generally adequate in use, it has not been entirely satisfactory in all respects.

More specifically, each of the two tubing strings can typically have at the outer end thereof a seal assembly, which includes a tube with one or more annular seals therearound. The seals may be damaged as the tubing string is inserted into the well. For example, as the seal assembly is run into the well, it may initially be coupled by shear pins to a locator. The locator is rotationally oriented when it reaches the region of the window, after which the pins are sheared in order to permit the seal assembly to continue moving without the locator. However, the remnants of the shear pins may engage and damage the seals. As another example, the window in the vertical casing may have jagged edges, and the jagged edges may tear the seals if they engage the seal assembly as it is routed from the main bore into the lateral bore.

A further problem is that the tubing string for the vertical bore is normally routed past the window through a passageway having a centerline that is radially offset from the centerline of the vertical bore, but may then need to be moved back toward the centerline of the vertical bore. For efficiency, the diameters of the two tubing strings are usually made as large as possible relative to the inside diameter of the vertical casing. As a result, there has traditionally been no satisfactory way to provide additional structure which would fit within the limited transverse space available around the tubing strings, and which could satisfactorily guide the tubing string gradually back toward the centerline of the vertical bore.

SUMMARY OF THE INVENTION

From the foregoing, it may be appreciated that a need has arisen for a method and apparatus for facilitating the use of dual tubing strings in a well, so as to avoid damage to seals of a seal assembly during insertion of the seal assembly, and so as to guide a tubing string past or through a window opening. According to the present invention, a method and apparatus are provided to address this need.

One form of the present invention involves: supporting a protective sleeve for axial movement relative to a seal section between a first position in which an annular seal around the seal member is disposed within the protective sleeve, and a second position in which the annular seal is axially spaced from the protective sleeve; inserting a tubing string into the well with the seal section thereon and the protective sleeve in its first position; and thereafter effecting movement of the protective sleeve from the first position to the second position.

Another form of the present invention involves: an elongate tubing string which can be removably inserted into a well in a lengthwise direction; an auxiliary part supported for upward axial movement along the tubing string away from an initial position; and a releasable coupling arrangement having a coupling state in which the coupling arrangement prevents upward movement of the auxiliary part away from the initial position relative to the tubing string, and having a release state in which the coupling arrangement permits the auxiliary part to move upwardly away from the initial position relative to the tubing string.

Yet another form of the present invention involves: a window assembly having an arrangement for supporting the window assembly within a vertical well bore in the region of a window, the window assembly having first and second tubing passageways therein, and having below the second tubing passageway an upwardly facing deflection surface portion which is inclined to extend downwardly toward the window, the deflection surface portion having a cross-sectional shape which is concave.

Still another form of the present invention involves: a window assembly having an arrangement for supporting the window assembly within a vertical well bore in the region of a window, and having first and second tubing passageways therein, the first tubing passageway having a first portion which has a centerline radially offset from a vertical centerline of the vertical bore, the second tubing passageway having a portion which is axially aligned with the first portion of the first tubing passageway, and the first tubing passageway having an elongate second portion which is below the first portion thereof and which is inclined at a small angle with respect to the centerline of the vertical bore so that an upper end of the second portion is farther from the centerline of the vertical bore than a lower end thereof.

BRIEF DESCRIPTION OF THE DRAWINGS

A better understanding of the present invention will be realized from the detailed description which follows, taken in conjunction with the accompanying drawings, in which:

FIG. 13 is a diagrammatic sectional view taken along the line 13—13 in FIG. 9;

FIG. 17 is a diagrammatic cutaway view taken along the line 17—17 in FIG. 13;

DETAILED DESCRIPTION OF THE INVENTION

The preferred embodiments of the present invention and its advantages are best understood by referring now in more detail to FIGS. 1–19 of the drawings, in which like numerals refer to like parts.

Figure 1:
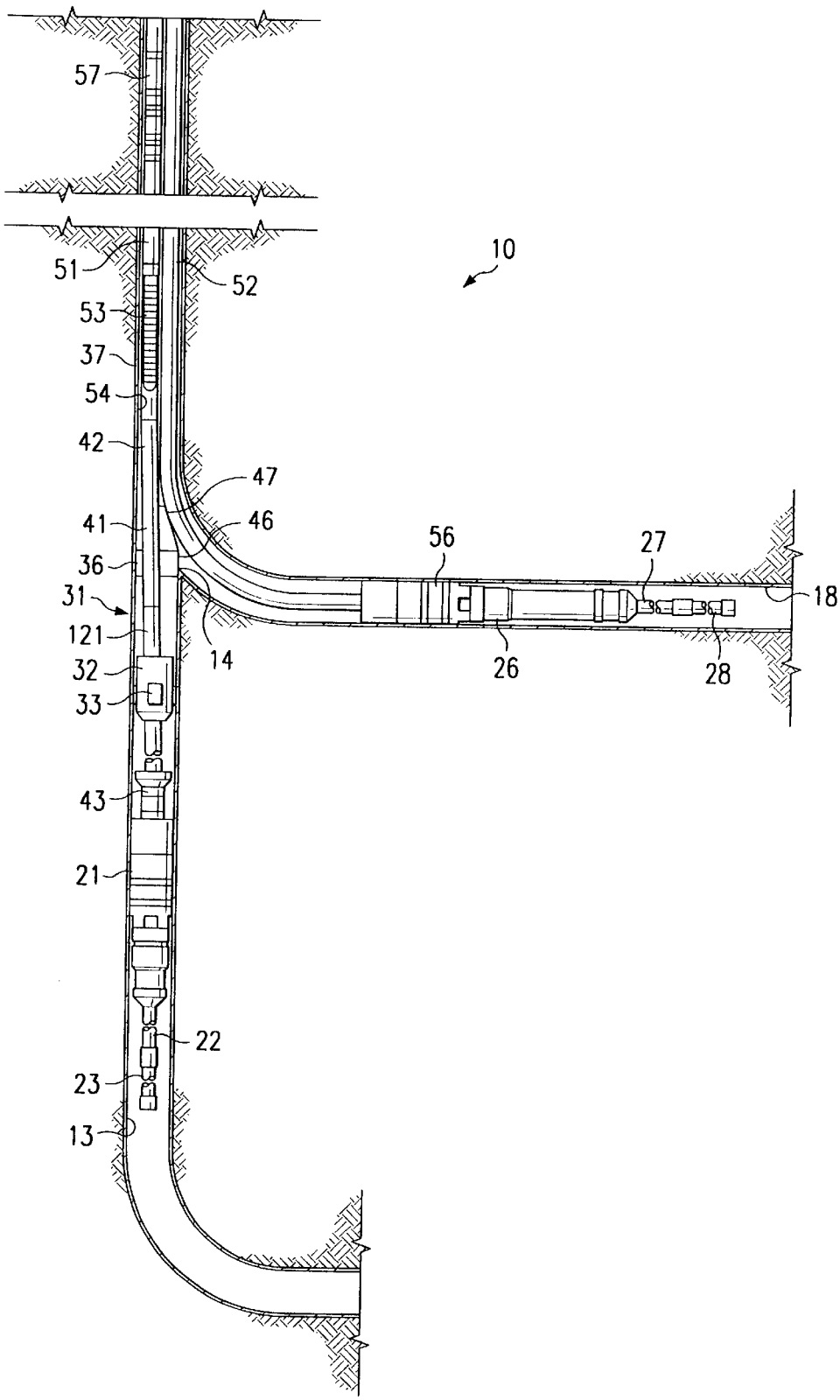
FIG. 1 is a diagrammatic sectional side view of a well having therein equipment which embodies the present invention.
Figure 2A:
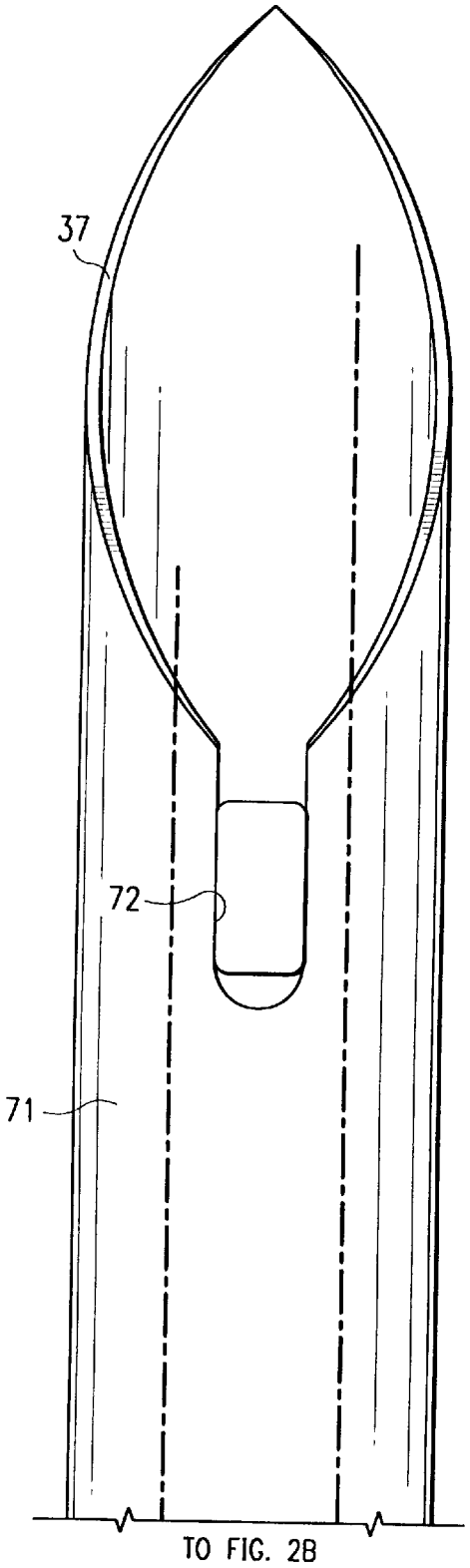
FIGS. 2A–2K are respective portions of a diagrammatic cutaway side view of a window assembly that is a component of the equipment shown in FIG. 1, and are collectively referred to herein as FIG. 2.
Figure 2B:
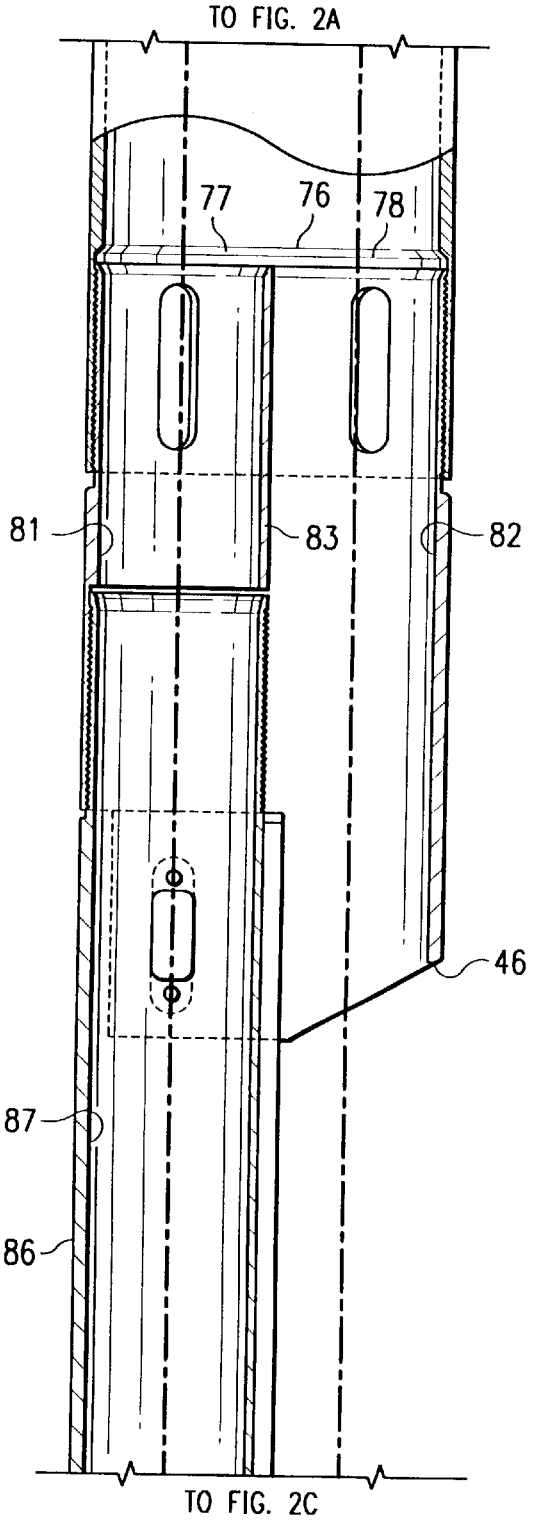
Figure 2C:
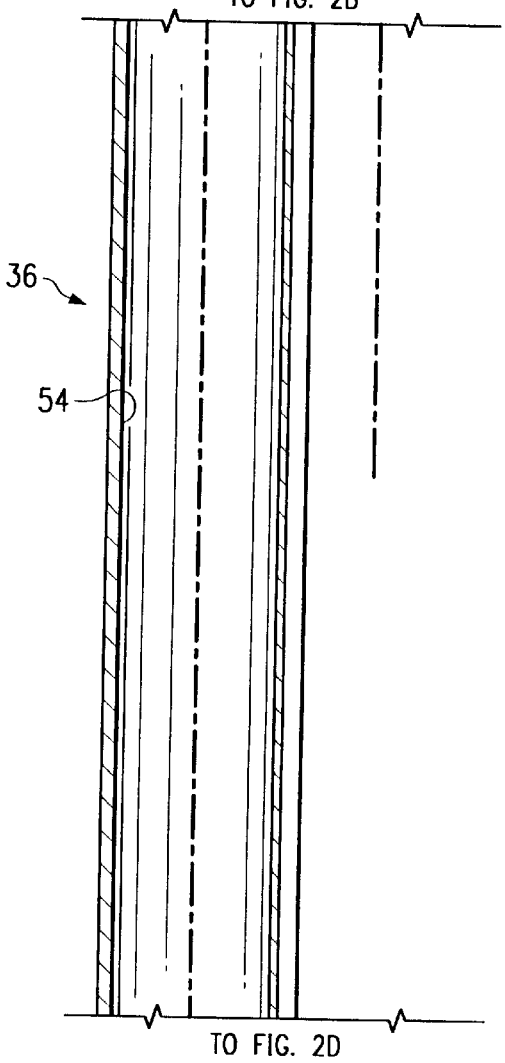
Figure 2D:
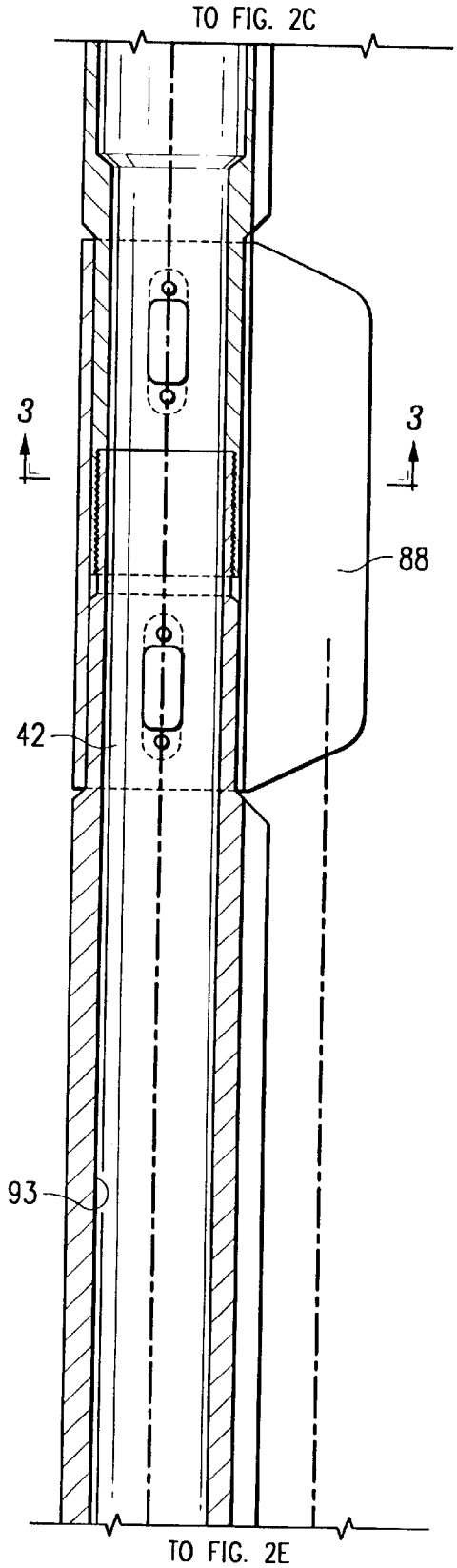
Figure 2E:
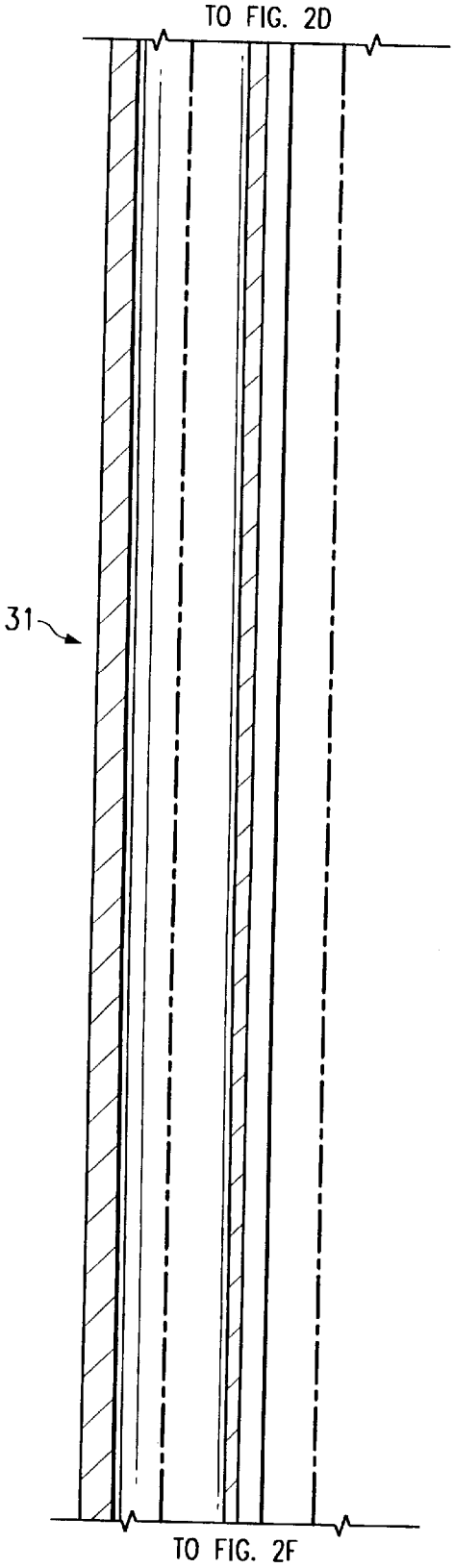
Figure 2F:
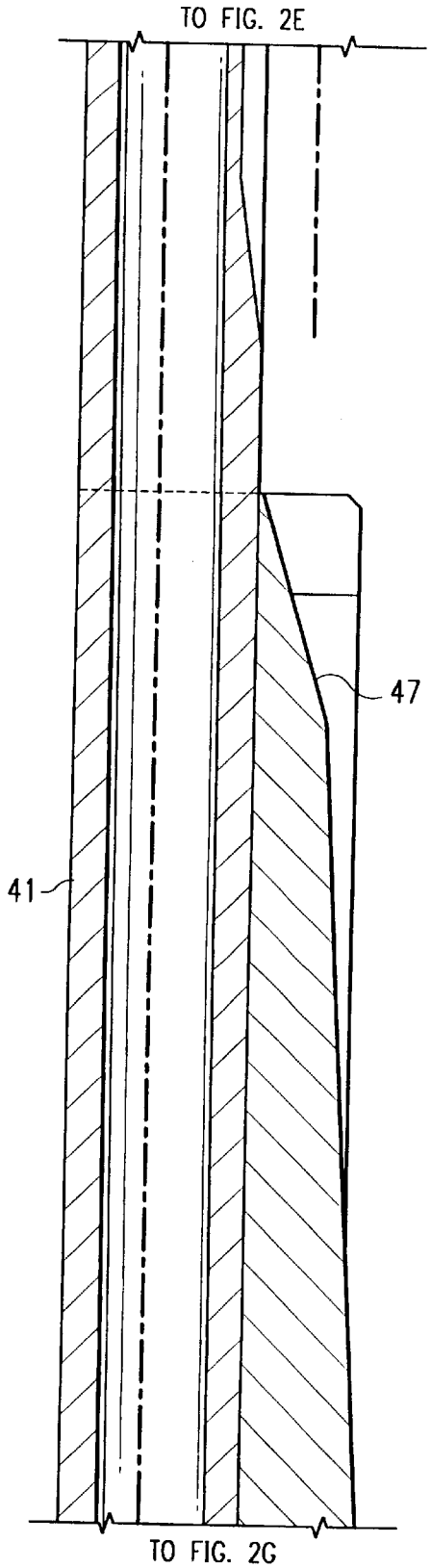
Figure 2G:
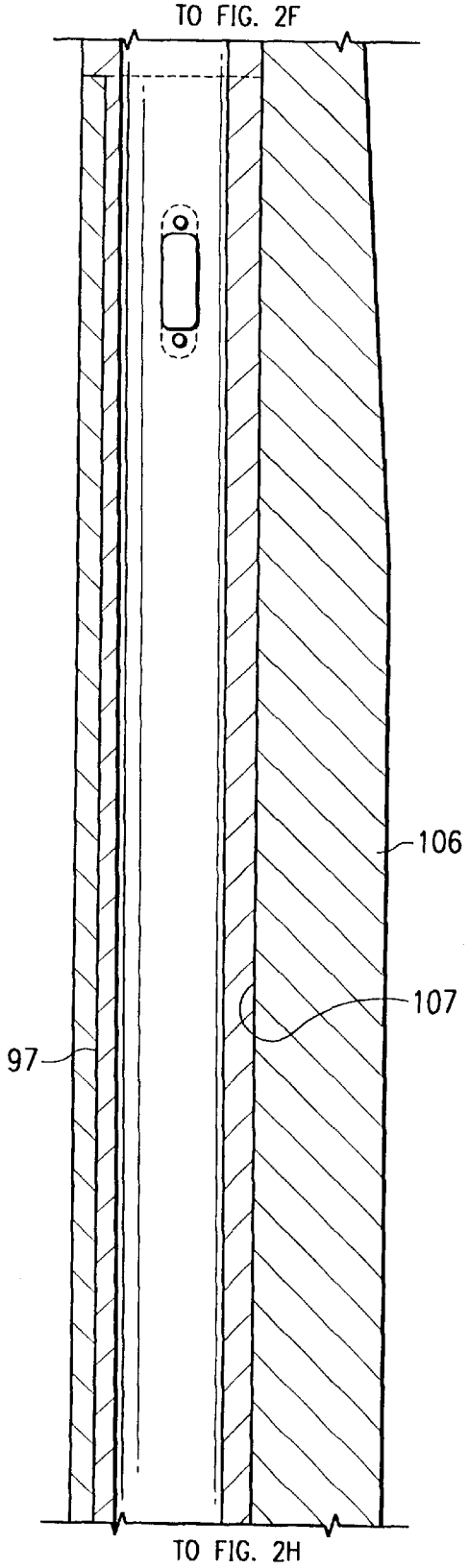
Figure 2H:
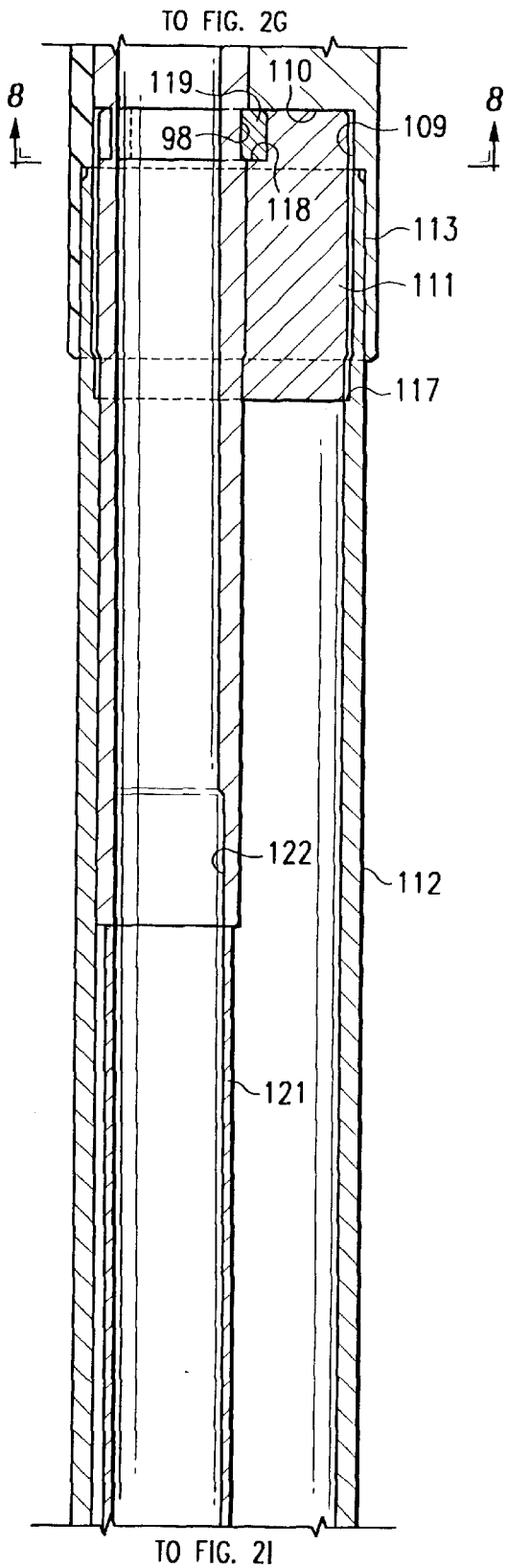
Figure 2I:
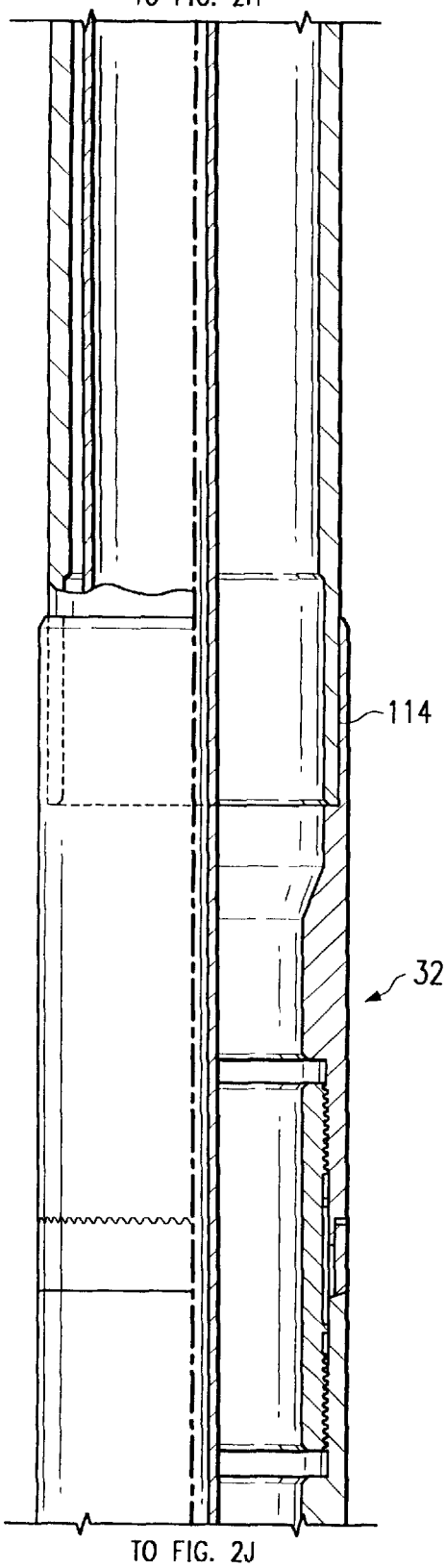
Figure 2J:
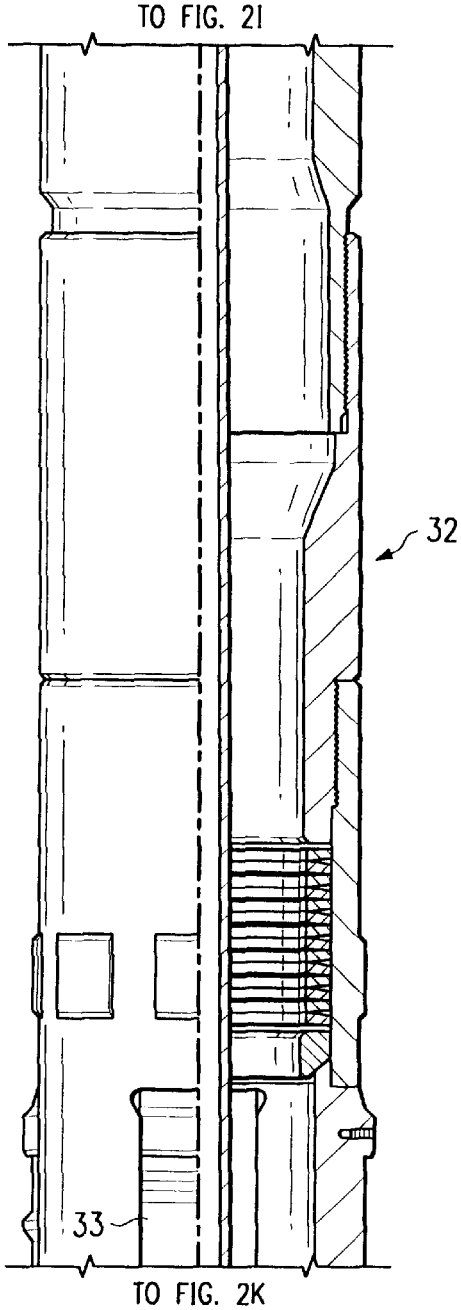
Figure 2K:
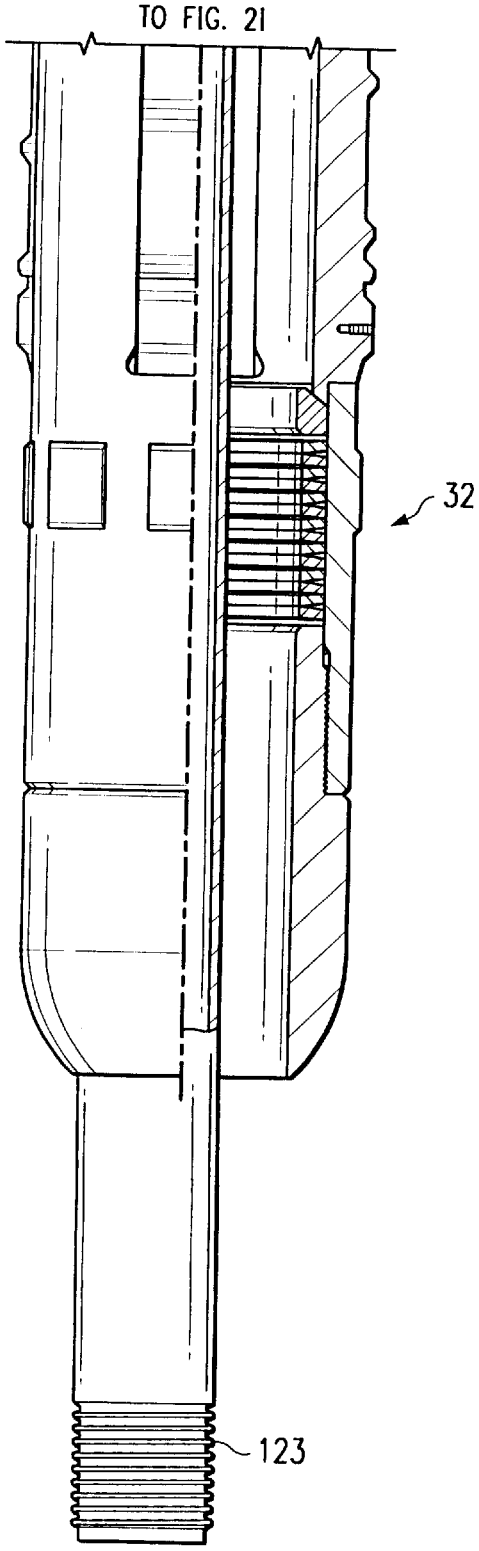

FIG. 1 is a diagrammatic cutaway side view of a well 10. The disclosed well 10 is used for the production of hydrocarbons, but the present invention is also suitable for use with other types of wells.

The well 10 includes a vertical bore having a vertical casing 13 cemented therein. The casing 13 has a window 14 milled in one side thereof, at a location spaced above the lower end of the casing 13. The well 10 also includes a lateral bore having a lateral casing 18 cemented therein, the lateral casing 18 communicating with the vertical casing 13 through the window 14.

In the disclosed embodiment, the vertical casing 13 has an inside diameter of approximately eight to nine inches, and the lateral casing 18 has an inside diameter of approximately six to seven inches. However, it will be recognized that the present invention is not limited to casings of any particular size. Further, although the casing 13 in the primary bore is identified herein as a vertical casing, this is solely for purposes of convenience, and it will be recognized that the casing 13 could have an orientation other than vertical.

A retrievable seal bore packer 21 is releasably fixedly secured in the vertical casing 13, at a location spaced below the window 14 and above the lower end of the casing 13. Although a retrievable packer 21 is used in the disclosed embodiment, it will be recognized that a permanent packer could alternatively be used. A tailpipe 22 extends downwardly from the packer 21, and has a perforated portion 23. A further retrievable seal bore packer 26 is releasably fixedly secured in the lateral casing 18, and has extending outwardly therefrom a tailpipe 27 with a perforated portion 28.

The vertical casing 13 has therein a window assembly, which is designated generally with reference numeral 31. The window assembly 31 is described in detail later, in association with FIG. 2, but is briefly described here for purposes of convenience. The window assembly 31 includes a latch mechanism 32, which has a plurality of circumferentially distributed keys 33 that engage matching profiles provided in the walls of the casing 13. The latch mechanism 32 serves to support the window assembly 31 at a desired vertical location within the vertical casing 13, and also maintains the window assembly 31 in a predetermined rotational orientation with respect to the vertical casing 13 and the window 14 therein.

The window assembly 31 also includes a dual bore deflector 36, which is secured to and extends upwardly from the latch mechanism 32, and which has an upper end at 37. The upper end 37 of the dual bore deflector 36 is a helical surface, only a portion of which is visible in FIG. 1.

The window assembly 31 further includes a long string tube 41, the upper end 42 of which is fixedly secured in the dual bore deflector 36 so that its centerline is radially offset from a vertical centerline of the vertical casing 13. The long string tube 41 is coupled at its lower end to a further tube 121. The tube 121 extends through a central opening in the latch mechanism 32, and at its lower end is fixedly secured to and communicates with a seal assembly 43. The seal assembly 43 sealingly engages a seal bore provided within the packer 21.

Extending axially through the long string tube 41 is a passageway, which is not visible in FIG. 1, but which is discussed in more detail later. The passageway has a gradual incline or deviation with respect to a vertical reference, so that it extends downwardly and inwardly toward the vertical centerline of the vertical casing 13. As will be discussed later, it is the passageway through the tube 41, and not the tube 41 itself, which is inclined. However, since the passageway is not visible in FIG. 1, the tube 41 is shown with a gradual incline in FIG. 1 in order to diagrammatically indicate the inclination of the passageway through it.

The dual bore deflector 36 of the window assembly 31 has in one side thereof an opening or window 46, which is vertically and rotationally aligned with the window 14 in the vertical casing 13. The dual bore deflector 36 has an upwardly facing deflector surface 47, which extends upwardly and inwardly from the lower edge of the window 46, at a sharp incline with respect to a horizontal reference. This may alternatively be viewed as a gradual incline with respect to the centerline of the vertical casing 13.

Two tubing strings 51 and 52 extend downwardly through the upper portion of the vertical casing 13. A seal assembly 53 is fixedly secured to and communicates with the lower end of the tubing string 51, and sealingly engages a seal bore 54 provided within the upper end of the dual bore deflector 36. The seal bore 54 communicates with the upper end 42 of the long string tube 41. The tubing string 52 extends past the deflector surface 47 and out into the lateral bore 18. A seal assembly 56 is secured to and communicates with the outer end of the tubing string 52. The seal assembly 56 sealingly engages a seal bore provided in the packer 26.

A dual string hydraulic set retrievable packer 57 is releasably fixedly secured in the vertical casing 13, at a location spaced above the window assembly 31, and has the tubing strings 51 and 52 extending through it. The packer 57 resists both upward and downward movement of the tubing string 51, and the tubing string 51 in turn resists upward movement of the window assembly 31.

FIGS. 2A–2K, which are collectively referred to as FIG. 2, are respective portions of a diagrammatic cutaway side view of the window assembly 31 of FIG. 1, except that the seal assembly 43 at the lower end of the window assembly has been omitted.

With reference to FIG. 2, the dual bore deflector 36 of the window assembly 31 has at its upper end a cylindrical rotation sleeve 71, the upper edge of which serves as the previously-mentioned helical surface 37. The sleeve 71 has a short slot 72, which extends axially downwardly from the lower end of the helical surface 37. At the lower end of the sleeve 71 is a horizontal circular wall 76, which has on the upper side thereof an upwardly facing flat surface which is normal to the centerline of the sleeve 71. The wall 76 has two adjacent circular openings 77 and 78 extending through it. The openings 77 and 78 are offset in opposite directions from the centerline of the sleeve 71, so that the centerline extends through a portion of the wall 76 which is disposed between the openings 77 and 78.

Figure 3:
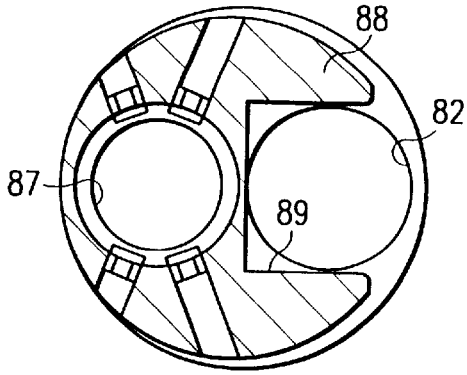
FIG. 3 is a diagrammatic sectional view taken along the line 3—3 in FIG. 2.

The dual bore deflector 36 has, immediately below the wall 76, two adjacent vertical cylindrical passageways 81 and 82, which each open into the sleeve 71 through a respective one of the circular openings 77 and 78. The passageways 81 and 82 are radially offset in opposite directions from the centerline of the sleeve 71, and a thin wall 83 is provided between them. The dual bore deflector 36 also includes an elongate tube 86, which has therethrough a cylindrical passageway 87 that is aligned with and communicates with the cylindrical passageway 81. The lower end of the tube 86 is fixedly secured to a torque fitting 88. FIG. 3 shows the cross-sectional shape of the torque fitting 88. It will be noted in FIG. 3 that the torque fitting 88 has in one side thereof a vertically extending recess or groove 89 of rectangular cross-sectional shape, which is aligned with the passageway 82.

Referring again to FIG. 2, it can be seen that the long string tube 41 has its upper end 42 fixedly secured to the torque fitting 88, so that a cylindrical passageway 93 therethrough is aligned with and communicates with the cylindrical passageway 87 in the tube 86. As evident from FIG. 2, the tube 41 extends generally vertically, but the cylindrical passageway 93 extends therethrough at a small angle with respect to a vertical reference, so that the centerline of the passageway 93 is slightly closer at its lower end than at its upper end to the vertical centerline of the window assembly.

Figure 6:
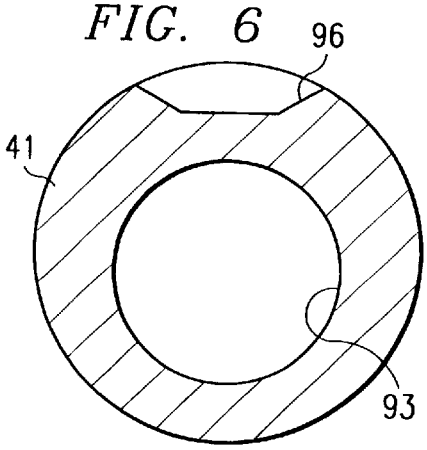
FIG. 6 is a diagrammatic sectional side taken along the line 6—6 in FIG. 5.
Figure 4:
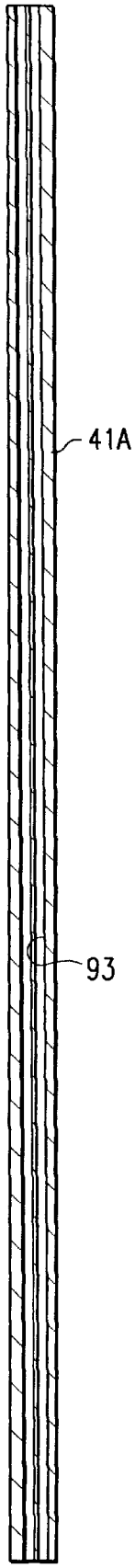
FIG. 4 is a diagrammatic sectional side view of a tube which is a component of the window assembly of FIG. 2, but before final machining has been performed on the tube.
Figure 5:
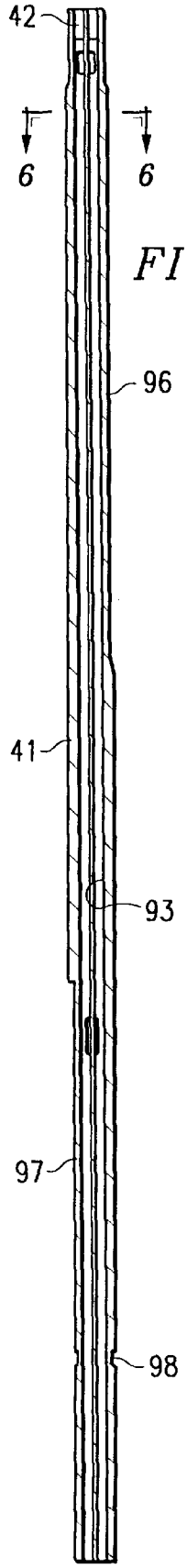
FIG. 5 is a diagrammatic sectional side view of the tube of FIG. 4, after final machining has been performed thereon.

FIGS. 4 through 6 provide additional information regarding the tube 41. More specifically, FIG. 4 shows a tube 41A, which is a part that will be subjected to additional machining in order to produce the final tube 41. In FIG. 4, the tube 41A is cylindrical, and has the cylindrical passageway 93 extending therethrough at an angle to the centerline of the cylindrical exterior surface of tube 41A. FIG. 5 shows the final tube 41 which results after additional machining is performed on the tube 41A. This additional machining includes machining an axially extending recess or groove 96 in one side of the upper end of the tube 41, machining a further recess 97 in the other side of the lower end of the tube 41, and machining a circumferential groove 98 around the lower portion the tube 41. FIG. 6 shows the shape of the axial groove 96, as well as the eccentricity of the passageway 93.

Figure 7:
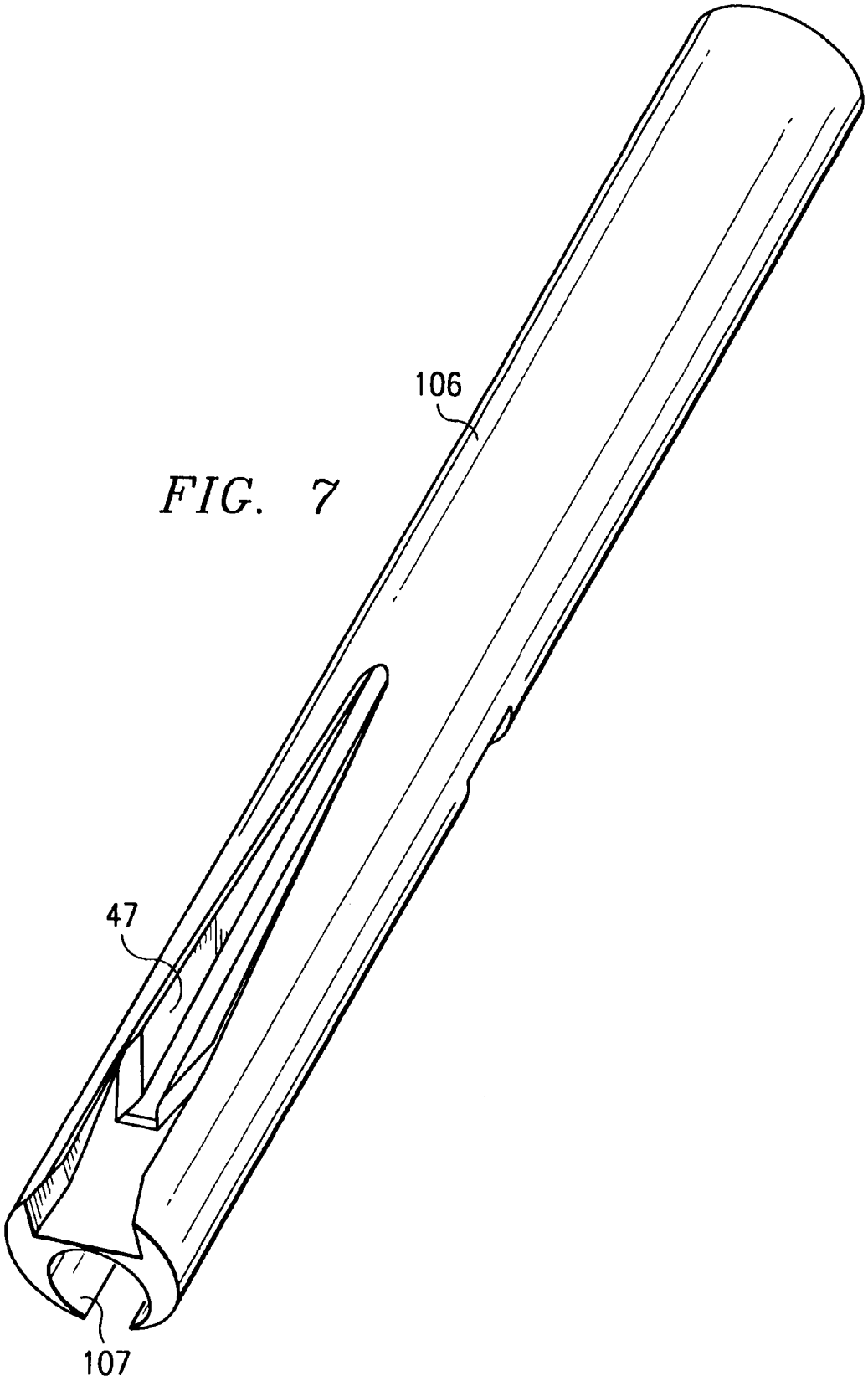
FIG. 7 is a diagrammatic perspective view of a deflector member which is a component of the window assembly of FIG. 2.

With reference to FIGS. 2 and 7, a deflector member 106 is cylindrical, and has extending axially therethrough an eccentric cylindrical opening 107, which receives the lower end of the long string tube 41. The deflector member 106 has on one side thereof at its upper end the deflector surface 47 which, as shown in FIG. 7, is a concave groove that progressively tapers in width and depth in a downward direction. As shown in FIG. 7, the groove has respective portions which are of rectangular cross-sectional shape and trapezoidal cross-sectional shape. However, the groove could also have other concave cross-sectional shapes, such as a semicircular cross-sectional shape.

Figure 8:
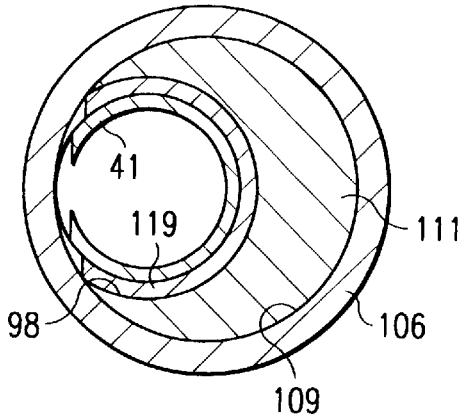
FIG. 8 is a diagrammatic sectional view taken along the line 8—8 in FIG. 2.

The cylindrical opening 107 in the deflector member 106 has at its lower end an enlarged portion 109, which defines an axially downwardly facing shoulder 110. a sleeve 111 is disposed within the enlarged portion 109. A tube 112 has its upper end secured within the enlarged portion 109 by threads 113, and has its lower end secured to the upper end of the latch 32 by threads 114. The tube 112 has thereon an axially upwardly facing shoulder 117, which engages the lower end of the sleeve 111 in order to hold the sleeve in place. The sleeve 111 has thereon an axially upwardly facing shoulder 118. As shown in FIGS. 2 and 8, a split ring 119 is disposed within the groove 98 in the tube 41, and also engages the shoulders 110 and 118, in order to fixedly secure the deflector member 106, the tube 112 and the latch 32 against vertical movement relative to the long string tube 41.

With reference to FIG. 2, and as previously mentioned, the further tube 121 has its upper end fixedly secured to the lower end of the long string tube 41, in particular by threads 122. The tube 121 extends downwardly through tube 112 and the latch 32, and projects outwardly beyond the lower end of the latch 32. The tube 121 has threads 123 at its lower end, by means of which the seal assembly 43 (FIG. 1) is fixedly secured to the lower end of the tube 121.

Figure 9A:
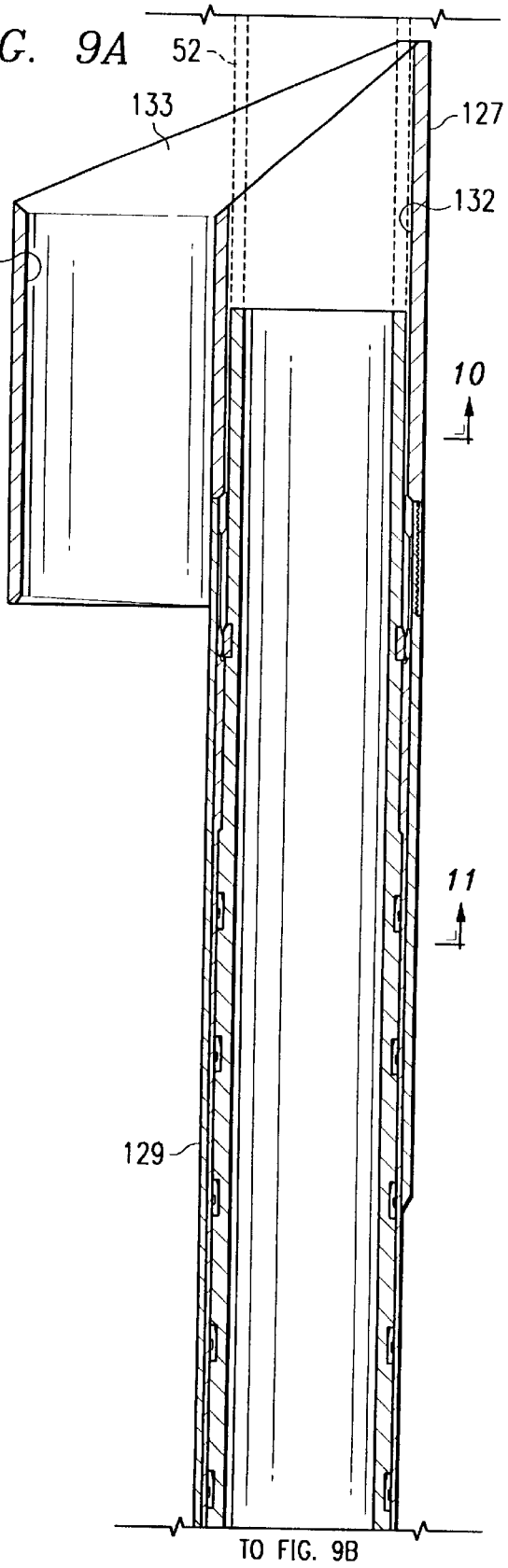
FIGS. 9A and 9B are respective portions of a diagrammatic cutaway side view of a locator, a protective sleeve and a seal assembly which are components of the equipment shown in FIG. 1, and are referred to collectively herein as FIG. 9.
Figure 10:
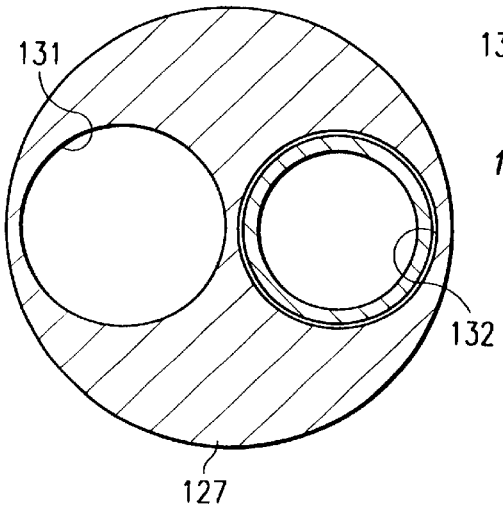
FIG. 10 is a diagrammatic sectional view taken along the line 10—10 in FIG. 9.
Figure 11:
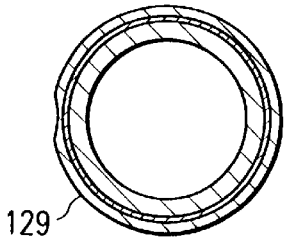
FIG. 11 is a diagrammatic sectional view taken along the line 11—11 in FIG. 9.
Figure 12:
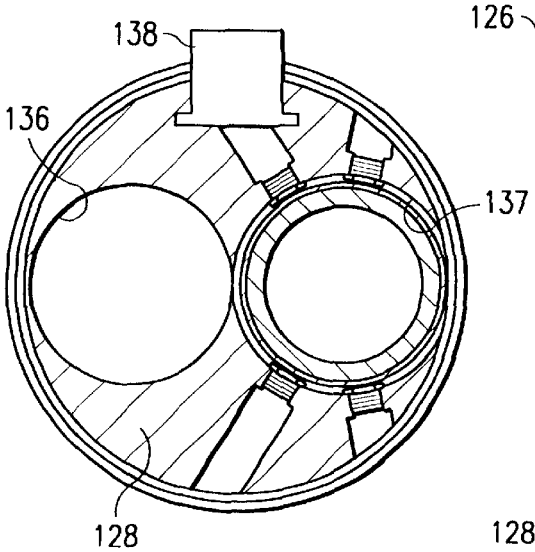
FIG. 12 is a diagrammatic sectional view taken along the line 12—12 in FIG. 9.
Figure 9B:
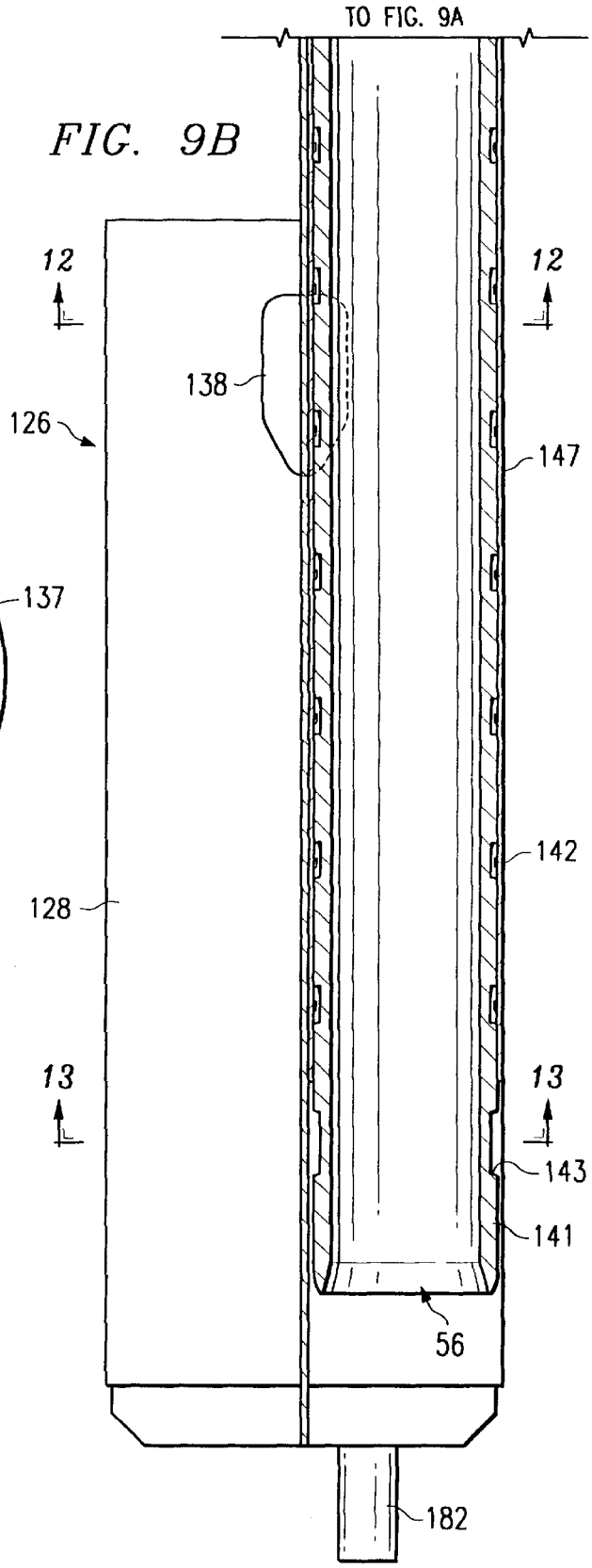

FIGS. 9A and 9B, which are collectively referred to as FIG. 9, are respective portions of a cutaway side view of a locator 126 and the seal assembly 56, before they are run into the well. The locator 126 is also known as a soft release running tool, and is shown somewhat diagrammatically in FIG. 9. The locator 126 has a cylindrical upper portion 127 and a cylindrical lower portion 128, which are fixedly coupled to each other by a cylindrical tube 129 extending between them.

The upper portion 127 of the locator has two cylindrical openings 131 and 132 which extend vertically therethrough and which are radially offset in opposite directions from the centerline of the locator, the opening 132 being aligned with the tube 129. The upper portion 127 has on the upper side thereof a scoop surface 133, which is concave and inclined toward the cylindrical opening 131.

The lower portion 128 of the locator has two cylindrical openings 136 and 137 which extend vertically therethrough and which are radially offset in opposite directions from the centerline of the locator, the opening 136 being aligned with the opening 131 in the upper portion 127, and the opening 137 being aligned with the tube 129 and with the opening 132 in the upper portion. The lower portion 128 has on one side thereof a radially outwardly projecting lug 138.

Figure 14:
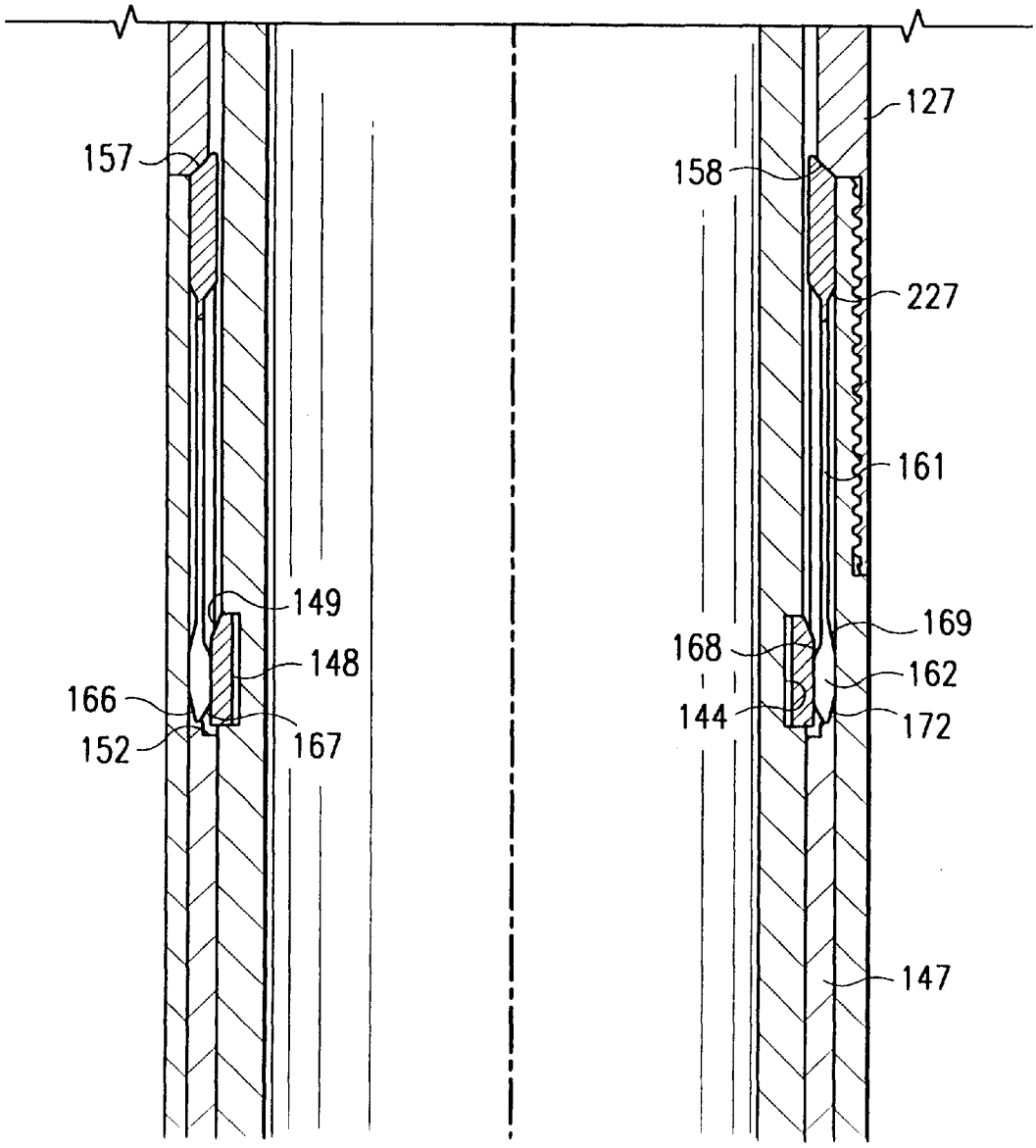
FIG. 14 is an enlarged view of a portion of FIG. 9.

With reference to FIG. 9, the tubing string 52 is shown in broken lines, and the seal assembly 56 which is secured to the end of tubing string 52 is shown in a position where it extends through the opening 132, the tube 129 and the opening 137. FIG. 14 is an enlarged view of a portion of FIG. 9, showing some details of the seal assembly.

With reference to FIGS. 9 and 14, the seal assembly 56 includes an elongate cylindrical seal tube 141, and includes a plurality of annular crimp seals 142, which are disposed in respective circumferential grooves provided at axially spaced locations along the outer surface of the tube 141. The tube 141 has near its lower end a circumferential groove 143, and has near its upper end a further circumferential groove 144. The seals 142 are all located between the grooves 143 and 144.

In FIG. 9, a cylindrical protective sleeve 147 closely encircles the tube 141 and the seals 142, with its upper end disposed above the groove 144, and its lower end disposed above the groove 143 but lower than the lowermost seal 142. The seals 142 are thus all disposed within the sleeve 147. The purpose of the sleeve 147 is to protect all of the seals 142 as the seal assembly 56 is inserted into the well. The protective sleeve 147 has a relatively thin radial wall thickness.

As best seen in FIG. 14, a split ring 148 is provided in the groove 144 of the seal tube 141, and is held against axial movement relative to the seal tube by the sidewalls of the groove 144. The split ring 148 is shown in a relaxed position in FIG. 14, in which it projects partially outwardly beyond the surface of the seal tube. The split ring 148 can be compressed radially inwardly from the position shown in FIG. 14, to a compressed condition in which it is disposed entirely within the groove 144 and does not project radially outwardly beyond the surface of the seal tube. The split ring 148 has at its upper end an upwardly and outwardly facing bevel surface 149. The protective sleeve 147 has an axially upwardly facing shoulder 152. In the insertion configuration shown in FIG. 14, the split ring 148 can engage the shoulder 152 in order to prevent downward movement of the seal tube 141 relative to the protective sleeve 147. This ensures that the seals 142 remain within and are protected by the protective sleeve 147 during insertion.

The seal tube 141 also has an upwardly facing annular bevel shoulder 153 which can engage a downwardly facing annular bevel shoulder 154 provided on the protective sleeve 147, in order to prevent upward movement of the seal tube 141 relative to the protective sleeve 147 beyond the position shown in FIG. 14. This ensures that the protective sleeve 147 does not slide downwardly and expose the seals 142 to damage. The protective sleeve 147 has at its upper end an upwardly and outwardly facing annular bevel shoulder 157 which can engage a downwardly and inwardly facing annular bevel shoulder 158 provided on the upper portion 127 of the locator 126. Engagement of the shoulders 157 and 158 limits upward movement of the seal tube 141 and the protective sleeve 147 beyond the position shown in FIG. 14 with respect to the locator 126.

Near its upper end, the protective sleeve 147 has a plurality of U-shaped slots which are circumferentially spaced and which each define a respective collet finger 161. The collet fingers 161 are integrally secured at their upper ends to the protective sleeve 147, and have lower ends 162 which are capable of limited radial movement through flexing of the collet fingers 161. During insertion, the lower ends 162 of the collet fingers engage the outer side of the split ring 148. The lower end of each collet finger has bevel surfaces 166–169 on both the inner and outer sides thereof, in order to allow the ends of the fingers to slide over other parts. A rib 172 may be provided on the protective sleeve 147, so as to engage the bevel surfaces 166 and 169 on each collet finger in a manner which limits radially outward movement of the lower ends of the collet fingers.

Figure 15:
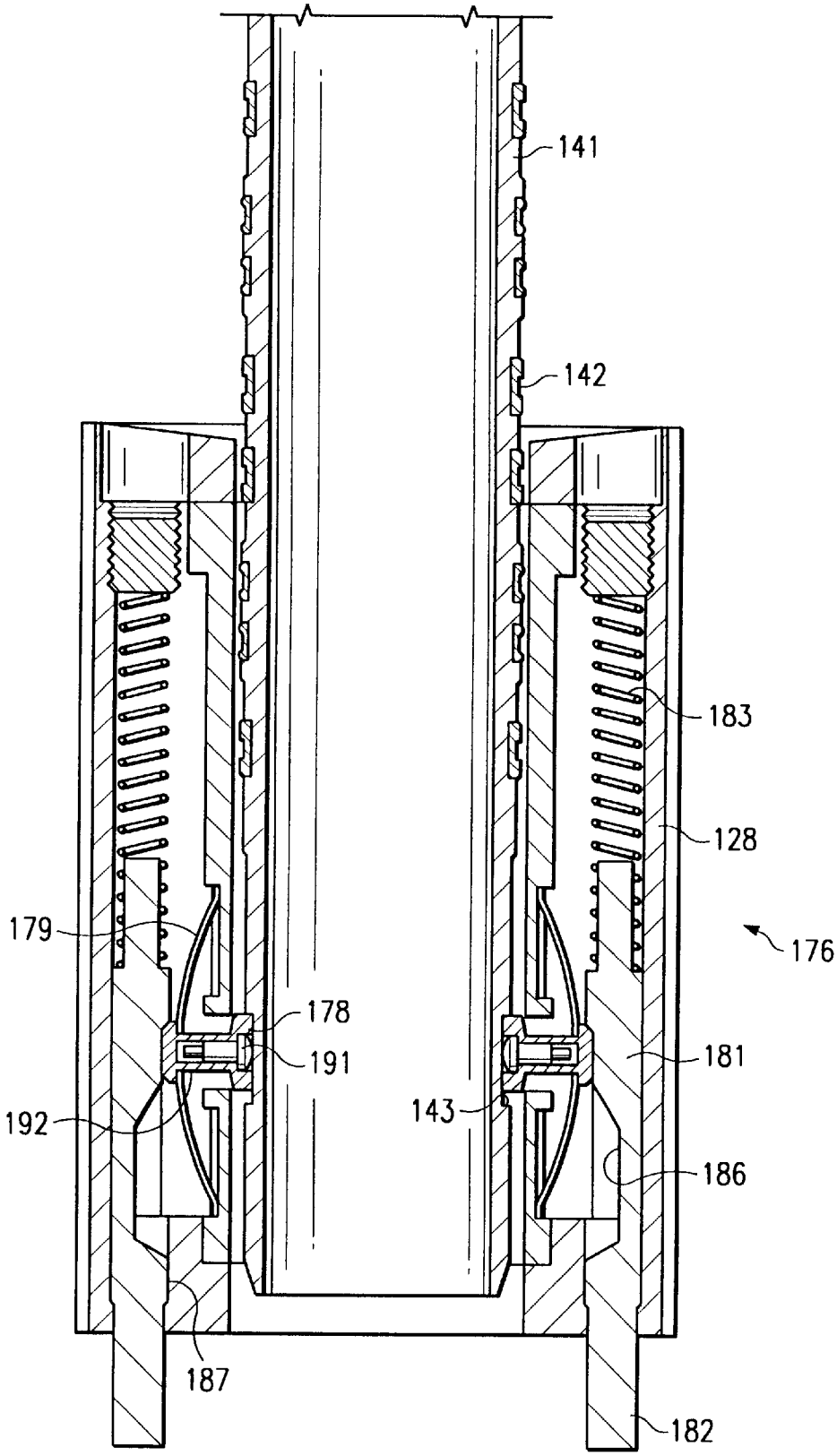
FIG. 15 is a diagrammatic cutaway view of a portion of the seal assembly and the locator of FIG. 9, and depicts a soft release coupling mechanism which is part of the locator or FIG. 9.
Figure 16:
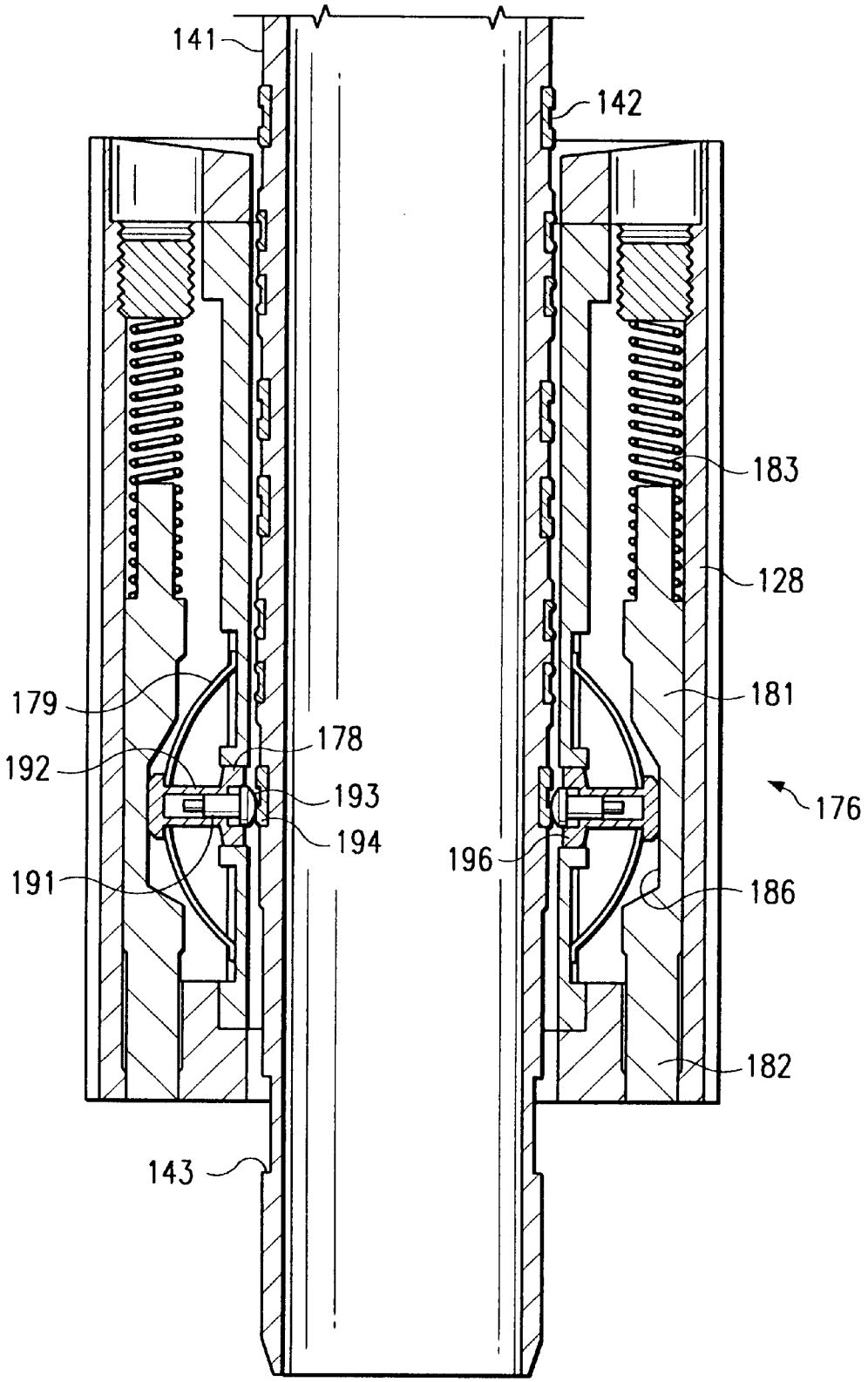
FIG. 16 is a diagrammatic cutaway view similar to FIG. 15, but showing the illustrated structure in a different operational position.

The seal assembly 56, as well as the protective sleeve 147, are held against vertical movement with respect to the locator 126 by a soft release coupling mechanism, which is disposed within the lower portion 128 of the locator 126 but which, for clarity, has been omitted from FIG. 9. One embodiment of this soft release coupling mechanism 176 is shown in FIGS. 15 and 16. FIGS. 15 and 16 show only selected portions of the lower portion 128, which are pertinent to the locking mechanism. Further, the protective sleeve 147 has been omitted for clarity in FIGS. 15 and 16, and because the locking mechanism is suitable for use with the seal tube 141 even where the protective sleeve 147 is not present.

In FIGS. 15 and 16, two dogs 178 are supported within the lower portion 128 of the locator 126 for radial movement between a position engaging the groove 143 (FIG. 15) and a position spaced radially outwardly from the tube 141 (FIG. 16). The dogs 178 are urged radially outwardly by respective leaf springs 179. Two control rods 181 are supported for axial movement relative to the lower portion 128 of the locator, between positions respectively shown in FIGS. 15 and 16. Each rod 181 has a lower end 182 which projects outwardly beyond the lower end of the locator in the position of FIG. 15, and which is flush with the lower side of the locator in the position of FIG. 16.

Each control rod 181 is urged downwardly by a respective helical compression spring 183. Each control rod 181 has thereon a cam surface 186, which in the position of FIG. 15 holds a respective dog 178 in the radially inner position in which the dog engages the groove 143, and which in the position of FIG. 16 permits the dog 178 to be moved radially outwardly by its spring 179 so that the dog is free of engagement with the tube 141. Each control rod 181 is initially secured against axial movement relative to the lower portion 128 of the locator by a shear pin, one of which is shown diagrammatically at 187.

In the embodiment of FIGS. 15 and 16, a catch or inner dog 191 is radially movably supported within each of the dogs 178, and is urged radially inwardly with respect to the dog by a compression spring 192. Thus, in the position of FIG. 16, the dogs 178 are spaced radially outwardly from the tube 141, but the catches 191 are each urged radially inwardly into engagement with the tube. Each catch 191 has bevel surfaces 193 and 194 which permit the catches to ride over the seals 142 without damaging the seals. Further, each catch 191 has a downwardly facing surface 196 which can engage the upwardly facing side surface of groove 143, in order to limit upward movement of the tube 141 relative to the locator 126.

FIGS. 13 and 17 show a soft release coupling mechanism 197, which is an alternative embodiment of the coupling mechanism 176. The coupling mechanism 197 is similar to the coupling mechanism 176, except as described below. In FIG. 17, the control rod 181 is shown with an opening 201, which receives an end of the shear pin 187 (FIG. 15). The control rod 181 also includes an axial slot 202 which receives an end of a not-illustrated setscrew in the lower portion 128 of the locator, in order to prevent rotational movement of the control rod 181 and in order to limit axial movement thereof. The hole 201 and the slot 202 are present in the control rods 181 of FIGS. 15 and 16, but are not visible in FIGS. 15 and 16.

The coupling mechanism 197 of FIGS. 13 and 17 differs from the coupling mechanism 176 of FIGS. 15 and 16 primarily in that the dogs are configured differently. In particular, with reference to FIGS. 13 and 17, two dogs 206 each have a head engagable with the groove 143 in the seal tube 141, and have a stem 207 which extends radially outwardly through an opening 205 provided in a wall of the lower portion 128 of the locator 126. A snap ring 208 is provided near the outer end of each stem 207, and a helical compression spring 211 extends between the snap ring 208 and the wall having the opening 205, so as to urge the dog 206 radially outwardly. The outer end of the stem 207 engages the cam surface 186 on a respective one of the control rods 181.

Figure 18A:
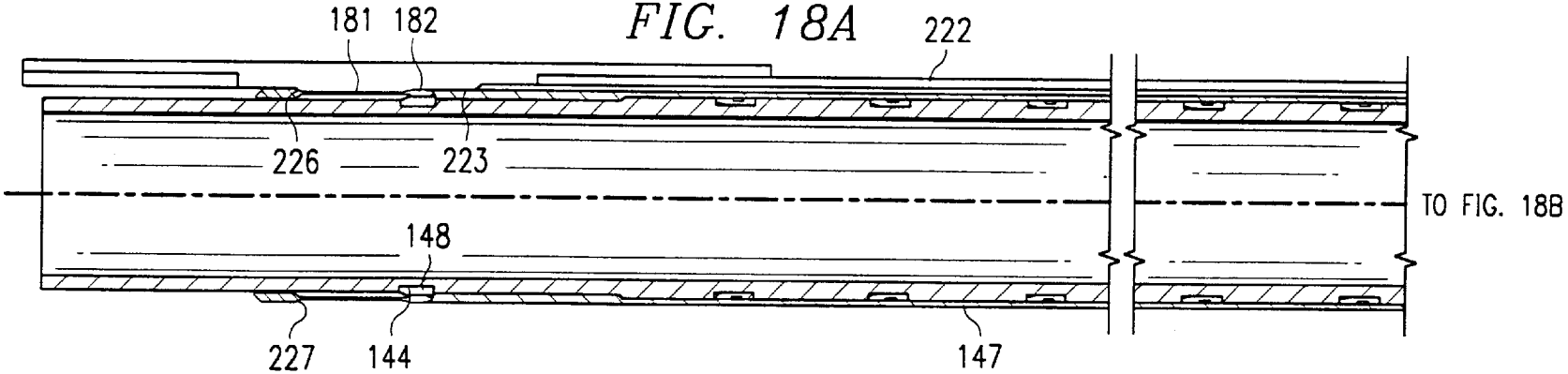
FIGS. 18A–18C are respective portions of a diagrammatic cutaway side view of a protective sleeve, a seal assembly and a packer that are components of the equipment shown in FIG. 1, and are referred to collectively herein as FIG. 18.
Figure 19A:
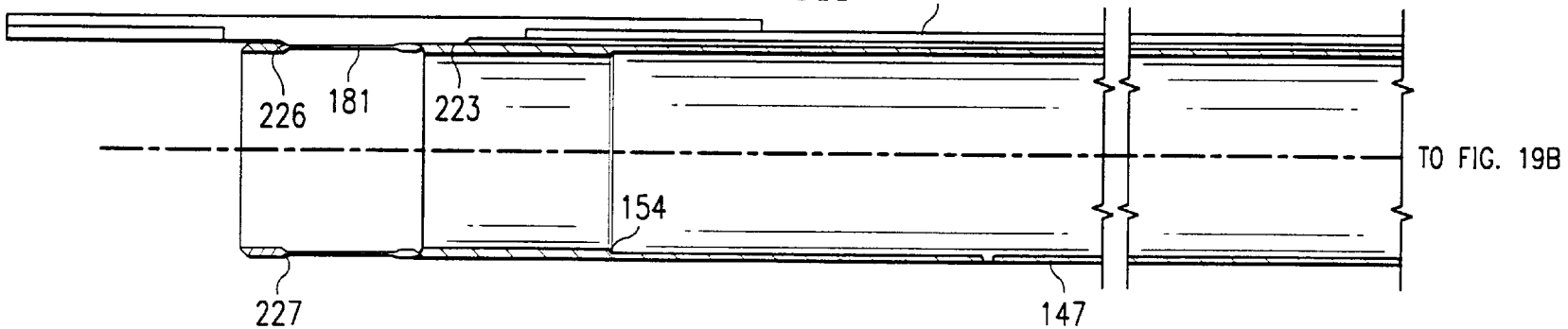
FIGS. 19A–19C are views similar to FIGS. 18A–18C but show the depicted structure in a different operational position, and are referred to collectively herein as FIG. 19.
Figure 18B:
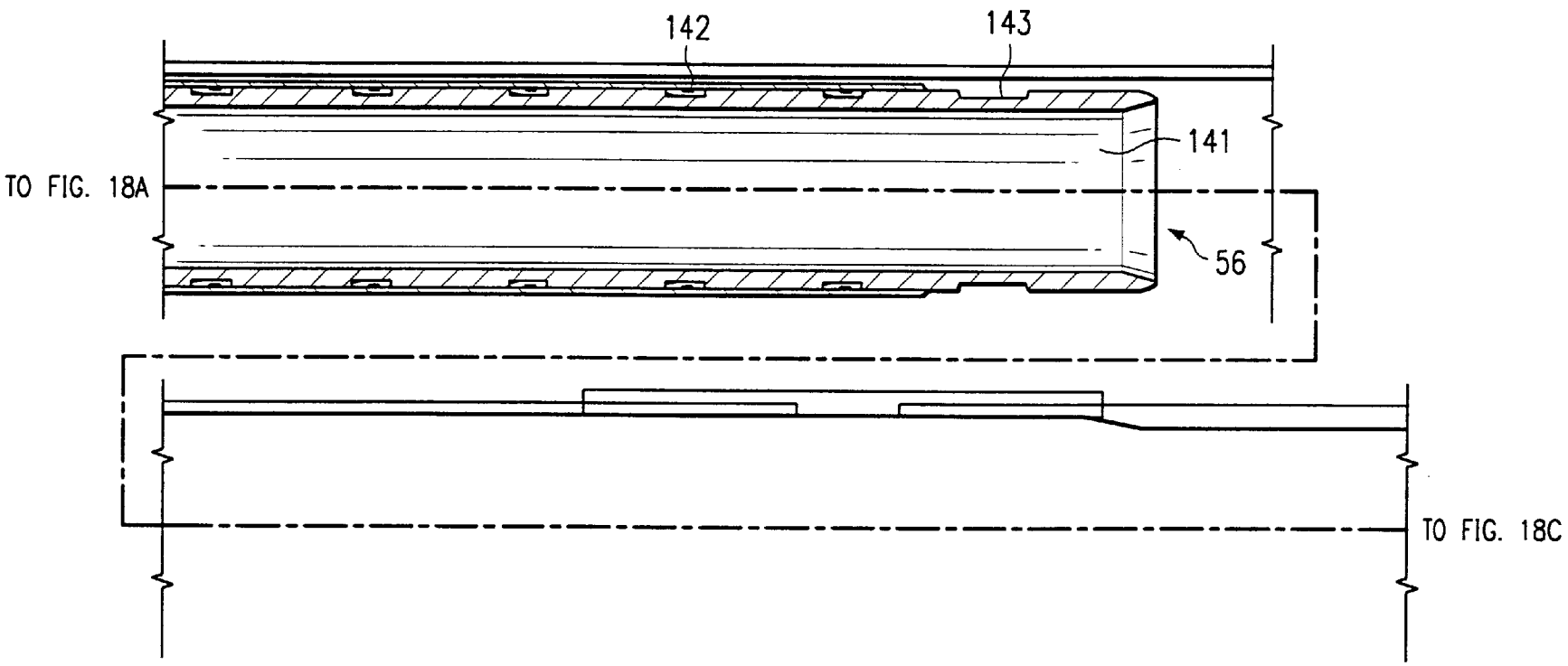
Figure 18C:
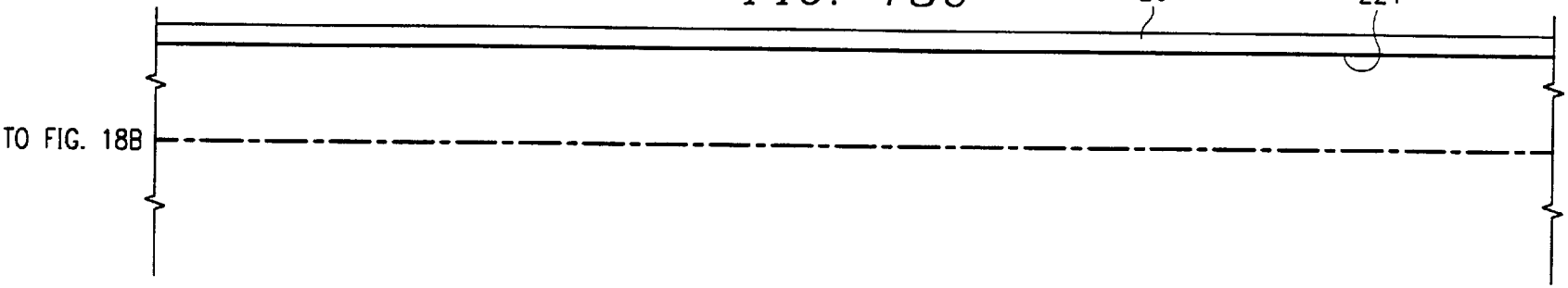
Figure 19C:
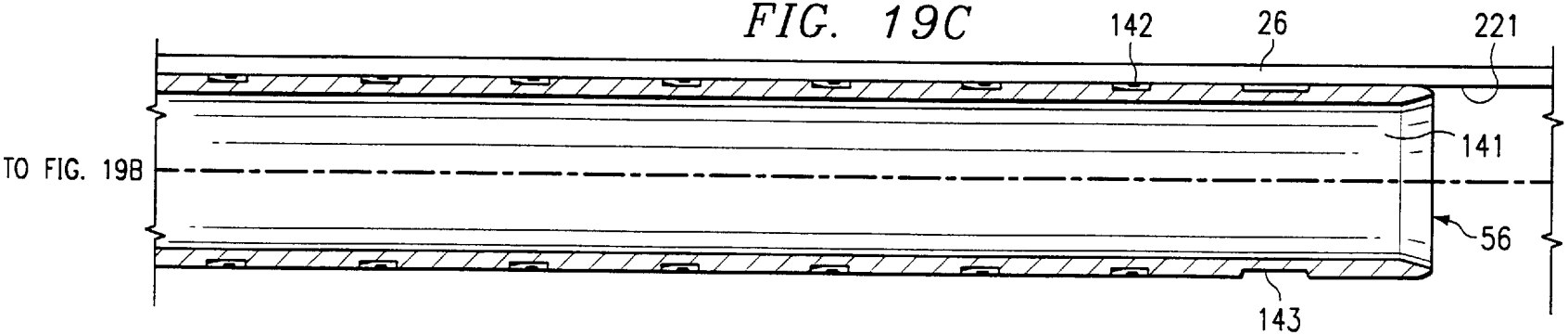
Figure 19B:
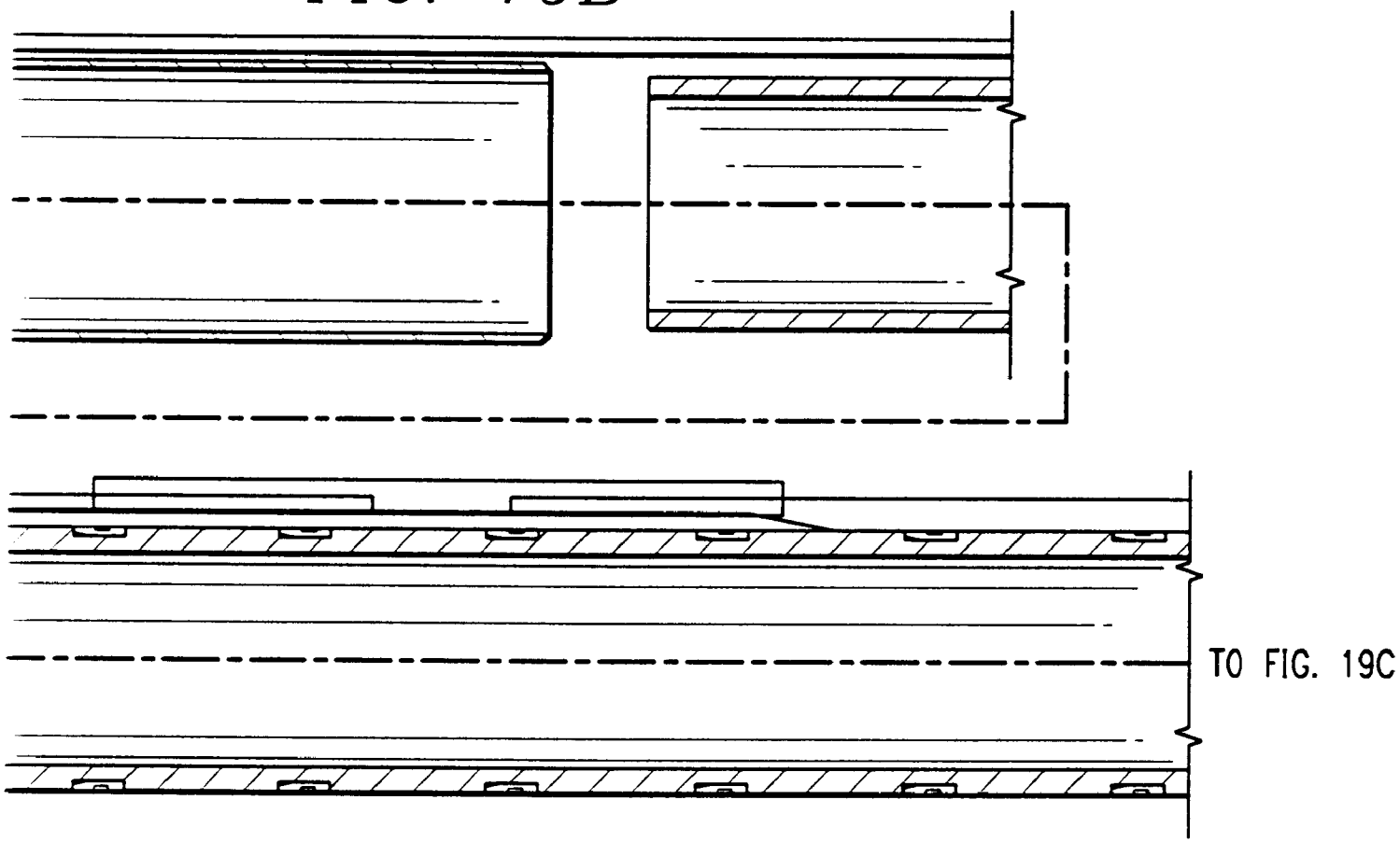

FIGS. 18A–18C, which are collectively referred to as FIG. 18, depict respective portions of a diagrammatic cutaway side view of the seal assembly 56 and the packer 26. FIGS. 19A–19C, which are collectively referred to as FIG. 19, are views corresponding to FIGS. 18A–18C, but show a different operational position.

With reference to FIGS. 18 and 19, the packer 26 has therein a cylindrical seal bore 221. A tubular cylindrical extension 222 is fixedly secured to an end of the packer 26 nearest the vertical casing 13, and extends away from the packer 26 toward the vertical casing. A cylindrical release surface 223 of reduced diameter is provided on the extension 222, near the end of the extension remote from the packer 26. An annular bevel shoulder 226 is provided at the end of the release surface 223 remote from the packer 26, the release surface 223 being engagable with a shoulder 227 provided on the protective sleeve 147.

The operation of the disclosed embodiments will now be briefly described. With reference to FIG. 1, it is assumed that the vertical and lateral bores of the well 10 have been drilled, and that the casings 13 and 18 have been cemented in place. The seal bore packer 26 is then installed in the lateral casing 18, and the seal bore packer 21 is installed in the vertical casing 13 below the window 14.

The entire window assembly 31 is then run into the vertical casing 13. The window assembly 31 is adjusted vertically and rotationally until the keys 33 engage the mating profiles provided in the walls of the vertical casing 13. Each of the keys 33 of the latch 32 has a unique profile, so that the window assembly 31 can have only a single angular orientation, in which the window 46 therein is necessary aligned with the window 14 in the casing 13. When the keys 33 are engaging the mating profiles in the casing 13, the seal assembly 43 will be sealing engaging the seal bore and the packer 21, as shown in FIG. 1.

Then, the dual tubing strings 51 and 52 are simultaneously run into the vertical casing 13. The seal assembly 53 on the tubing string 51 will be vertically higher than the seal assembly 56 on the tubing string 52. For example, the distance separating them could be approximately 500 feet, in which case the packer 26 in the lateral casing 18 would be approximately 500 feet away from the vertical casing 13. As the dual tubing strings 51 and 52 are run into the well with the seal assemblies 53 and 56 in this offset configuration, the dual string hydraulic set retrievable packer 57 is run in on the strings, at a location above the seal assembly 53. The soft release coupling mechanism 197 (FIGS. 13 and 17) releasably secures the locator 126 with respect to the seal assembly 56 and the protective sleeve 147, as shown in FIGS. 9 and 14.

When the locator 126 reaches the window assembly 31, it will enter the rotation sleeve 71 provided at the upper end of the window assembly. If the lug 138 is rotationally aligned with the slot 72, the locator 126 will move straight downwardly and the lug 138 will slide into the slot 72. Typically, however, this rotational alignment will not initially exist, in which case the lug 138 will engage and slide along the helical surface 37 in response to further downward movement of the locator 126, and will rotate the locator 126 until the lug 138 is aligned with and slides into the slot 72.

As the lug 138 moves into the slot 72, the lower end of the locator will approach the wall 76 at the lower end of the sleeve 71. As this occurs, the wall 76 will engage the lower ends 182 of the two control rods 181 and push them upwardly with respect to the locator 126, thereby shearing the shear pins 187 which were resisting such upward movement of the control rods 181. As the control rods 181 move upwardly with respect to the locator 126 against the urging of the springs 183, the cam surfaces 186 thereon shift so as to allow the springs 211 to move the dogs 206 radially outwardly, out of engagement with the groove 143 provided in the seal tube 141. This permits the seal tube 141 to move downwardly relative to the locator 126, away from the insertion position of the seal assembly 56 which is shown in FIG. 9. Due to the engagement between the split ring 148 and the shoulder 152 on the protective sleeve 147, the protective sleeve 147 continues downwardly with the seal assembly 56. The springs 211 ensure that the dogs 206 do not engage the seal assembly 56 as it moves downwardly. This is particularly significant when the protective sleeve 147 is not being used, because it ensures that the dogs 206 do not engage and damage the seals 142 on the tube 141.

When the lowermost end of the seal assembly 56 reaches the deflector surface 47 (FIGS. 1 and 2), the lower end is deflected laterally outwardly into the lateral casing 18. The concave shape of the deflector surface 47 will help to keep the seal assembly centered as it is deflected toward the lateral casing 18. This is particularly significant if the protective sleeve 147 is not being used, because it helps reduce the likelihood that the seal assembly will engage the edges of the window 14, which can inflict damage to the seals 142. Where the protective sleeve 147 is being used, it will protect the seals 142 from jagged edges of the window 14, even if the seal assembly 56 does happen to engage the edges of the window 14. Thereafter, as the tubing strings 51 and 52 continue to be run into the well, the seal assembly 56 and the protective sleeve 147 will move further outwardly into the lateral bore 18.

With reference to FIGS. 18 and 19, the seal assembly 56 and protective sleeve 147 will eventually enter the tubular extension 222 on the packer 26 in the lateral casing 18, until the shoulder 227 on the protective sleeve engages the shoulder 226 on the extension 222. The engagement of the shoulders 226 and 227 will prevent further movement of the protective sleeve 147 into the extension 222. At this point, as shown in FIG. 18, the ends 182 of the collet fingers 181 on the protective sleeve 147 are disposed within the cylindrical release surface 223 on the extension 222. The diameter of the cylindrical release surface 223 is selected so that it presses the ends 182 of the collet fingers 181 radially inwardly, and they in turn compress the split ring 148 sufficiently to release the engagement between the split ring 148 and the shoulder 152 (FIG. 14) on the protective sleeve 147. This permits the seal assembly 56 to continue to move ahead into the packer 26 while the protective sleeve remains in the extension 222, as shown in FIG. 19. The seals 142 on the seal assembly 56 sealingly engage the seal bore 221 provided in the packer 26, as shown in FIG. 19.

As the seal assembly 56 enters the packer 26, the seal assembly 53 (FIG. 1) on the tubing string 51 approaches the upper end of the locater 126. The scoop surface 133 (FIG. 9) on the upper end of the locator 126 guides the seal assembly 53 toward the opening 131, so that the seal assembly 53 enters the opening 131, passes through the opening 136, and enters the seal bore 54 provided in the upper end of the window assembly 31. Thus, the seal assembly 56 seals within the packer 26 substantially simultaneously with the seal assembly 53 sealing within the seal bore 54, as shown in FIG. 1. Then, while applying weight to the tubing strings 51 and 52, the dual string hydraulic set retrievable packer 57 is actuated. Thereafter, through the tubing string 51, the packer 57 helps prevent upward movement of the window assembly 31. The window assembly 31, in conjunction with the seals at 21, 26, 54 and 57, provides a seal junction which has been rated at a pressure of at least 5,000 psi.

In order to remove the tubing strings 51 and 52, the packer 57 is released, and the tubing strings 51 and 52 are run upwardly. This extracts the seal assembly 53 from the upper end of the window assembly 31. Further, movement of the tubing string 52 pulls the seal assembly 56 out of the seal bore 221 (FIG. 19) of the packer 26, and back into the protective sleeve 147 disposed within the extension 222, as shown in FIG. 18. At this point, the shoulder 153 on the seal assembly 56 engages the shoulder 154 on the protective sleeve 147. As the tubing string 52 is further run upwardly, the protective sleeve 147 will be pulled along with the seal assembly 56.

When the seal assembly 56 and the protective sleeve 147 reach and enter the window assembly 31, they will move upwardly until they enter the locator 126 and reach the position shown in FIGS. 9 and 14. In this position, the shoulder 157 at the upper end of the protective sleeve 147 engages the shoulder 158 on the locator. This prevents further upward movement of the protective sleeve 147 relative to the locator 126. Therefore, as the tubing string 52 continues to be run upwardly, it pulls the seal assembly 56 upwardly, which in turn pulls the protective sleeve 147 upwardly by virtue of the engagement between shoulders 153 and 154, and the protective sleeve 147 in turn pulls the locator 126 upwardly, by virtue of the engagement between shoulders 157 and 158.

The soft release coupling mechanism 197 which is disclosed in FIGS. 13 and 17 operates in substantially the same manner described above for the coupling mechanism 176. Accordingly, the operation of the coupling mechanism 197 is not described here in detail.

An optional variation is that a not-illustrated coupling arrangement could be provided between the seal tube 141 and the protective sleeve 147, in order to positively lock these parts together after they reach the relative position shown in FIG. 19. Then, as the seal tube 141 was withdrawn from the well, the protective tube 147 would be prevented from moving back down over the seals 142. Although this would expose the seals to potential damage during withdrawal, the seals would normally be replaced before the seal tube 141 was used again, and so any damage to them during withdrawal would not be significant.

Although multiple embodiments have been illustrated and described, it will be understood that various changes, substitutions and alterations can be made therein, including the rearrangement and reversal of parts, without departing from the scope of the present invention, as defined by the following claims.

What is claimed is:

1. A method of running first and second tubing strings into a well, the second tubing string including a seal assembly and a sleeve enclosing the seal assembly, and the well having first and second intersecting wellbores, the method comprising the steps of:

positioning an assembly in the first well bore, so that a deflection surface formed on the assembly faces towards the second wellbore, and a passageway formed through the assembly communicates with the first wellbore above and below the assembly;

attaching a locator to the second tubing string, the locator including first and second bores, and the second tubing string being received in, and releasably secured against reciprocable displacement through, the second bore; and engaging the locator with the assembly, thereby aligning the first bore with the releasing passageway, aligning the second bore with the deflection surface, and releasing the second tubing string for reciprocable displacement through the second bore.

2. The method according to claim 1, further comprising the step of diplacing the second tubing string through the second bore, so that the second tubing string contacts the deflection surface and is deflected into the second wellbore.

3. The method according to claim 2, further comprising the step of displacing the sleeve relative to the seal assembly in the second wellbore, so that the sleeve no longer encloses the seal assembly.

4. The method according to 3, further comprising the steps of:

withdrawing the second tubing string from the second wellbore, thereby displacing the sleeve so that it encloses the seal assembly; and abutting and displacing the locator with the second tubing string, thereby disengaging the locator from the assembly.

5. The method according to claim 1, further comprising the step of inserting the first tubing string through the first bore and into the assembly passageway.

6. The method according to claim 5, further comprising the step of sealingly engaging the first tubing string within the assembly passageway.

7. The method according to claim 1, wherein in the engaging step, the first and second tubing strings are displaced simultaneously in the first wellbore.

8. A method of running first and second tubing strings into a well, the second tubing string including seals covered by a protective sleeve, and the well having first and second intersecting wellbores, the method comprising the steps of:

positioning an assembly in the first wellbore, so that a deflection surface formed on the assembly faces toward the second wellbore, and a passageway formed through the assembly communicates with the first wellbore above and below the assembly;

attaching a locator to the second tubing string, the second tubing string being releasably secured against reciprocal displacement relative to the locator;

engaging the locator with the assembly, thereby releasing the second tubing string for reciprocal displacement relative to the locator and aligning the second tubing string with the deflection surface; and deflecting the second tubing string into the second wellbore.

9. The method according to claim 8, further comprising the step of displacing the protective sleeve to uncover the seals after the deflecting step.

10. The method according to claim 8, further comprising the step of simultaneously running the first and second tubing strings into the first wellbore.

11. The method according to claim 8, further comprising the step of substantially simultaneously sealingly engaging the first tubing string with the passageway and sealingly engaging the second tubing string seals with a sealing device in the second wellbore.

12. The method according to claim 8, wherein the engaging step further comprises aligning the first tubing string with passageway.

13. A method of running first and second tubing strings into a well, the second tubing string including seals covered by a protective sleeve, and the well having a first and second intersecting wellbores, the method comprising the steps of:

positioning an assembly in the first wellbore, so that a deflection surface formed on the assembly faces toward the second wellbore, and a passageway formed through the assembly communicates with the first wellbore above and below the assembly;

running the first and second tubing strings simultaneously into the first wellbore after the step of positioning the assembly in the first wellbore;

sealingly engaging the first tubing string with the passageway in response to the running step; and deflecting the second tubing string off of the deflection surface and into the second wellbore in response to the running step.

14. The method according to claim 13, wherein the deflecting step further comprises engaging a locator with the assembly, the locator being releasably attached to the second tubing string.

15. The method according to claim 14, wherein the engaging step further comprises aligning the first tubing string with the passageway in response to the locator engaging the assembly.

16. The method according to claim 13, further comprising the steps of positioning a seal bore in the second wellbore prior to the running step, and sealingly engaging the second tubing string seals with the seal bore after the deflecting step.

17. The method according to claim 16, wherein the first tubing string sealingly engaging step and the second tubing string sealingly engaging step are performed substantially simultaneously.

* * * * *